US009415915B2

(12) United States Patent
Spivey, Sr. et al.

(10) Patent No.: US 9,415,915 B2
(45) Date of Patent: Aug. 16, 2016

(54) CARTON FOR ARTICLES

(71) Applicant: Graphic Packaging International, Inc., Atlanta, GA (US)

(72) Inventors: Raymond R. Spivey, Sr., Mableton, GA (US); Robert L. Sutherland, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/286,343

(22) Filed: May 23, 2014

(65) Prior Publication Data

US 2014/0346070 A1 Nov. 27, 2014

Related U.S. Application Data

(60) Provisional application No. 61/855,819, filed on May 24, 2013, provisional application No. 61/956,388, filed on Jun. 7, 2013.

(51) Int. Cl.

| | |
|---|---|
| ***B65D 71/30*** | (2006.01) |
| ***B65D 5/54*** | (2006.01) |
| ***B65B 5/02*** | (2006.01) |

(Continued)

(52) U.S. Cl.

CPC . *B65D 71/30* (2013.01); *B31B 1/25* (2013.01); *B31B 1/26* (2013.01); *B65B 5/024* (2013.01); *B65D 5/46192* (2013.01); *B65D 5/542* (2013.01); *B65D 71/34* (2013.01); *B65D 71/36* (2013.01); *B65D 2571/00141* (2013.01); *B65D 2571/00462* (2013.01);

(Continued)

(58) Field of Classification Search

CPC ..... B65D 2571/00882; B65D 2571/00141; B65D 2571/00462; B65D 2571/00469; B65D 2571/00561; B65D 2571/0066; B65D 5/2033

See application file for complete search history.

(56) References Cited

U.S. PATENT DOCUMENTS

| | | | |
|---|---|---|---|
| 902,347 | A | 10/1908 | Tillinghast |
| 1,541,143 | A | 6/1925 | Hoile |

(Continued)

FOREIGN PATENT DOCUMENTS

| | | |
|---|---|---|
| DE | 1 192 099 | 4/1965 |
| DE | 2 323 589 | 11/1974 |

(Continued)

OTHER PUBLICATIONS

International Search Report and Written Opinion for PCT/US2014/039351 dated Oct. 16, 2014.

(Continued)

*Primary Examiner* — Andrew Perreault

(74) *Attorney, Agent, or Firm* — Womble Carlyle Sandridge & Rice, LLP

(57) ABSTRACT

A carton for containing a plurality of articles. The carton can comprise a plurality of panels that extends at least partially around an interior of the carton. The plurality of panels can comprise a bottom panel, a top panel, and a side panel. At least two end flaps are respectively foldably attached to respective panels of the plurality of panels. The at least two end flaps can at least partially form a closed end of the carton, and the at least two end flaps can comprise a first end flap foldably connected to at least one panel of the plurality of panels at a first fold line and a second end flap foldably connected to the at least one panel at a second fold line. The second fold line is oblique relative to the first fold line.

61 Claims, 36 Drawing Sheets

(51) Int. Cl.

| | |
|---|---|
| ***B31B 1/25*** | (2006.01) |
| ***B31B 1/26*** | (2006.01) |
| ***B65D 71/34*** | (2006.01) |
| ***B65D 5/46*** | (2006.01) |
| ***B65D 71/36*** | (2006.01) |

(52) U.S. Cl.

CPC ..... *B65D 2571/00469* (2013.01); *B65D 2571/00561* (2013.01); *B65D 2571/00882* (2013.01)

(56) References Cited

U.S. PATENT DOCUMENTS

| | | | |
|---|---|---|---|
| 1,925,102 | A | 9/1933 | Levkoff |
| 2,115,673 | A | 4/1938 | Stompe |
| 2,124,808 | A | 7/1938 | White et al. |
| 2,448,819 | A | 9/1948 | Mitchell |
| 2,718,301 | A | 9/1955 | Palmer |
| 2,723,027 | A | 11/1955 | Guyer |
| 2,754,047 | A | 7/1956 | Schmidt et al. |
| 2,800,224 | A | 7/1957 | Taylor et al. |
| 2,842,304 | A | 7/1958 | Ringler |
| 2,868,431 | A | 1/1959 | Painter |
| 2,919,844 | A | 1/1960 | Anderson, Jr. |
| 2,930,516 | A | 3/1960 | Fowle et al. |
| 2,975,891 | A | 3/1961 | Stone |
| 2,990,097 | A | 6/1961 | Thompson |
| 3,002,651 | A | 10/1961 | Gauld |
| 3,018,031 | A | 1/1962 | Ahlbor et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| RE26,083 | E | 9/1966 | Forrer |
| 3,300,115 | A | 1/1967 | Schauer |
| 3,332,594 | A | 7/1967 | Capua |
| 3,356,279 | A | 12/1967 | Root |
| 3,517,858 | A | 6/1970 | Farquhar |
| 3,540,581 | A | 11/1970 | Koolnis |
| 3,599,858 | A | 8/1971 | Samsing |
| 3,669,251 | A | 6/1972 | Phillips |
| 3,765,527 | A | 10/1973 | Vargo |
| 3,807,624 | A | 4/1974 | Funkhouser |
| 3,894,681 | A | 7/1975 | Arneson et al. |
| 3,913,739 | A | 10/1975 | Hennessey |
| 3,942,631 | A | 3/1976 | Sutherland et al. |
| 4,000,811 | A | 1/1977 | Hardinson et al. |
| D243,508 | S | 3/1977 | Killy |
| 4,030,596 | A | 6/1977 | Snyder et al. |
| D252,259 | S | 7/1979 | Rinehart |
| 4,214,660 | A | 7/1980 | Hunt, Jr. |
| 4,216,861 | A | 8/1980 | Oliff |
| 4,222,485 | A | 9/1980 | Focke |
| D263,204 | S | 3/1982 | Dutcher |
| 4,325,482 | A | 4/1982 | Feeser |
| 4,364,509 | A | 12/1982 | Holley, Jr. et al. |
| 4,375,258 | A | 3/1983 | Crayne et al. |
| D269,068 | S | 5/1983 | Mann et al. |
| D270,041 | S | 8/1983 | Vestal |
| 4,396,143 | A | 8/1983 | Killy |
| 4,416,410 | A | 11/1983 | Herrmann |
| 4,417,655 | A | 11/1983 | Forbes, Jr. |
| 4,417,661 | A | 11/1983 | Roccaforte |
| 4,465,180 | A | 8/1984 | Klygis |
| 4,498,581 | A | 2/1985 | Dutcher |
| 4,577,762 | A | 3/1986 | Kuchenbecker |
| 4,582,199 | A | 4/1986 | Schuster |
| D286,987 | S | 12/1986 | Golan et al. |
| 4,726,471 | A | 2/1988 | Whately et al. |
| 4,747,485 | A | 5/1988 | Chaussadas |
| 4,756,419 | A | 7/1988 | Le Bras |
| 4,785,991 | A | 11/1988 | Schuster |
| D303,090 | S | 8/1989 | Armor et al. |
| 4,860,944 | A | 8/1989 | Wonnacott |
| 4,890,440 | A | 1/1990 | Romagnoli |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,771 | A | 12/1990 | Lavery |
| 4,981,253 | A | 1/1991 | Quaintenance |
| 5,002,186 | A | 3/1991 | Cooper |
| 5,031,825 | A | 7/1991 | Romagnoli |
| 5,067,615 | A | 11/1991 | Davitian |
| 5,101,642 | A | 4/1992 | Alexandrov |
| 5,123,589 | A | 6/1992 | Cote |
| 5,137,211 | A | 8/1992 | Summer et al. |
| 5,170,934 | A | 12/1992 | Lemoine |
| D332,915 | S | 2/1993 | Hoell et al. |
| 5,246,112 | A | 9/1993 | Stout et al. |
| 5,277,360 | A | 1/1994 | DeMott |
| 5,279,440 | A | 1/1994 | Fougeres et al. |
| 5,284,292 | A | 2/1994 | Johnson |
| 5,333,734 | A | 8/1994 | Stout et al. |
| 5,368,194 | A | 11/1994 | Oliff et al. |
| 5,427,242 | A | 6/1995 | Oliff et al. |
| 5,465,831 | A | 11/1995 | Smith |
| 5,505,372 | A | 4/1996 | Edson et al. |
| 5,518,111 | A | 5/1996 | Stout |
| 5,536,194 | A * | 7/1996 | Larsen ..... A63H 37/00 229/108.1 |
| 5,595,339 | A | 1/1997 | Correll |
| 5,622,309 | A | 4/1997 | Matsuda et al. |
| 5,664,683 | A | 9/1997 | Brody |
| 5,690,213 | A | 11/1997 | Matsumura |
| 5,704,470 | A | 1/1998 | Sutherland |
| 5,722,584 | A | 3/1998 | Fujiwara |
| 5,775,574 | A | 7/1998 | Whitnell |
| 5,826,783 | A | 10/1998 | Stout |
| 5,833,118 | A | 11/1998 | Weiss |
| 5,873,515 | A | 2/1999 | Dunn et al. |
| 5,875,961 | A | 3/1999 | Stone et al. |
| 5,878,947 | A | 3/1999 | Hoy et al. |
| 5,881,884 | A | 3/1999 | Podosek |
| 5,921,398 | A | 7/1999 | Carroll |
| 5,924,559 | A | 7/1999 | Carrel et al. |
| 6,105,854 | A | 8/2000 | Spivey |
| 6,155,480 | A | 12/2000 | Botsford et al. |
| D436,859 | S | 1/2001 | Botsford et al. |
| 6,176,419 | B1 | 1/2001 | Holley, Jr. |
| 6,283,293 | B1 | 9/2001 | Lingamfelter |
| D454,784 | S | 3/2002 | Oram |
| 6,386,369 | B2 | 5/2002 | Yuhas et al. |
| 6,409,077 | B1 | 6/2002 | Telesca et al. |
| 6,435,351 | B1 | 8/2002 | Gibb |
| 6,478,219 | B1 | 11/2002 | Holley, Jr. |
| 6,550,615 | B2 | 4/2003 | Linghamfelter |
| 6,578,736 | B2 | 6/2003 | Spivey |
| 6,631,803 | B2 | 10/2003 | Rhodes et al. |
| 6,715,639 | B2 | 4/2004 | Spivey |
| 6,752,262 | B1 | 6/2004 | Boriani et al. |
| 6,866,186 | B2 | 3/2005 | Fogle et al. |
| 7,000,803 | B2 | 2/2006 | Miller |
| 7,100,798 | B2 | 9/2006 | Spivey |
| 7,237,674 | B2 | 7/2007 | Auclair |
| 7,766,219 | B2 | 8/2010 | Gomes et al. |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185527 | A1 | 12/2002 | Bates |
| 2003/0141353 | A1 | 7/2003 | Wilson |
| 2003/0192905 | A1 | 10/2003 | Spivey |
| 2004/0060972 | A1 | 4/2004 | Harrelson |
| 2004/0099558 | A1 | 5/2004 | Oliff et al. |
| 2004/0164133 | A1 | 8/2004 | Harrelson |
| 2004/0188277 | A1 | 9/2004 | Auclair |
| 2004/0232034 | A1 | 11/2004 | Lebras |
| 2005/0178687 | A1 | 8/2005 | Spivey, Sr. |
| 2005/0178791 | A1 | 8/2005 | Miller |
| 2005/0263574 | A1 | 12/2005 | Schuster |
| 2006/0000881 | A1 | 1/2006 | Sutherland |
| 2006/0108406 | A1 | 5/2006 | Stewart et al. |
| 2006/0254942 | A1 | 11/2006 | Cargile, Jr. |
| 2006/0261140 | A1 | 11/2006 | Holley, Jr. |

(56) References Cited

U.S. PATENT DOCUMENTS

| | | | |
|---|---|---|---|
| 2008/0237320 | A1 | 10/2008 | Philips |
| 2010/0044420 | A1 | 2/2010 | Brand et al. |
| 2013/0213991 | A1 | 8/2013 | Harrelson |

FOREIGN PATENT DOCUMENTS

| | | | |
|---|---|---|---|
| DE | 75 10 538 | | 8/1975 |
| DE | 76 06 493 | | 6/1976 |
| DE | 29 33 022 | | 2/1980 |
| DE | 30 07 769 | | 9/1981 |
| DE | 81 35 176 | | 5/1982 |
| DE | G 85 14 718.4 | | 6/1985 |
| DE | G 86 29 664.7 | | 5/1987 |
| DE | 36 12 594 | | 10/1987 |
| DE | 40 23 043 | | 12/1991 |
| DE | 94 12 885 | | 10/1994 |
| DE | 94 13 813 | | 10/1994 |
| DE | 295 19 931 | | 2/1996 |
| DE | 296 02 010 | | 3/1996 |
| DE | 299 09 008 | | 9/1999 |
| DE | 29913585 | | 10/1999 |
| DE | 694 21 620 | | 4/2000 |
| EP | 0 235 852 | | 9/1987 |
| EP | 0 323 596 | | 7/1988 |
| EP | 0 342 088 | | 11/1989 |
| EP | 0 475 147 | | 3/1992 |
| EP | 0 752 370 | | 1/1997 |
| EP | 0 849 189 | | 6/1998 |
| EP | 0 899 200 | A1 | 3/1999 |
| EP | 1 060 998 | | 12/2000 |
| EP | 1 262 417 | | 12/2002 |
| FR | 2 549 010 | | 1/1985 |
| FR | 2 581 970 | | 11/1986 |
| WO | WO 88/09750 | | 12/1988 |
| WO | WO 95/01284 | | 1/1995 |
| WO | WO 95/25668 | | 9/1995 |
| WO | WO 96/29260 | | 9/1996 |
| WO | WO 97/21607 | | 6/1997 |
| WO | WO 98/31593 | | 7/1998 |
| WO | WO 98/38099 | | 9/1998 |
| WO | WO 99/64301 | | 12/1999 |
| WO | WO 00/23334 | | 4/2000 |
| WO | WO 00/71428 | | 11/2000 |
| WO | WO 01/28871 | | 4/2001 |
| WO | WO 02/04302 | | 1/2002 |
| WO | WO 02/30785 | | 4/2002 |
| WO | WO 02/085739 | | 10/2002 |
| WO | WO 03/082686 | | 10/2003 |
| WO | WO 2004/043790 | | 5/2004 |

OTHER PUBLICATIONS

International Search Report and Written Opinion for PCT/US2015/031904 dated Aug. 28, 2015.

* cited by examiner

L1
L2

1
3
10
12
12a
12b
13
14
14a
14b
15
16
16a
16b
17
20
21
21a
22
22a
22b
24
25
27
30
31
31a
32
33
40
41
41a
42
42a
42b
44
45
47
50
51
51a
52
53
54
56
57
58
59
64
66
67
68
69
75
77
79
81
83
85
87
91
93
95
97
99
101
107
108
109
110
111
112
113
114
115
116
117
118

CARTON FOR ARTICLES

CROSS-REFERENCE TO RELATED APPLICATIONS

This application claims the benefit of U.S. Provisional Patent Application No. 61/855,819, filed May 24, 2013, and U.S. Provisional Patent Application No. 61/956,388, filed Jun. 7, 2013.

INCORPORATION BY REFERENCE

The disclosures of U.S. Provisional Patent Application No. 61/855,819, which was filed on May 24, 2013, and U.S. Provisional Patent Application No. 61/956,388, which was filed Jun. 7, 2013, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons configured to receive articles in a nested arrangement.

SUMMARY OF THE DISCLOSURE

In general, one aspect of the disclosure is directed to a carton for containing a plurality of articles. The carton can comprise a plurality of panels that extends at least partially around an interior of the carton. The plurality of panels can comprise a bottom panel, a top panel, and a side panel. At least two end flaps are respectively foldably attached to respective panels of the plurality of panels. The at least two end flaps can at least partially form an at least partially closed end of the carton, and the at least two end flaps can comprise a first end flap foldably connected to at least one panel of the plurality of panels at a first fold line and a second end flap foldably connected to the at least one panel at a second fold line. The second fold line is oblique relative to the first fold line.

In another aspect, the disclosure is generally directed to a blank for forming a carton for containing a plurality of articles. The blank can comprise a plurality of panels comprising a bottom panel, a top panel, and a side panel, and at least two end flaps respectively foldably attached to respective panels of the plurality of panels. The at least two end flaps can be for at least partially forming an at least partially closed end of the carton formed form the blank, and the at least two end flaps can comprise a first end flap foldably connected to at least one panel of the plurality of panels at a first fold line and a second end flap foldably connected to the at least one panel at a second fold line. The second fold line is oblique relative to the first fold line.

In another aspect, the disclosure is generally directed to a method of forming a carton for containing a plurality of articles. The method can comprise obtaining a blank comprising a plurality of panels comprising a bottom panel, a top panel, and a side panel, and at least two end flaps respectively foldably attached to respective panels of the plurality of panels. The at least two end flaps can comprise a first end flap foldably connected to at least one panel of the plurality of panels at a first fold line and a second end flap foldably connected to the at least one panel at a second fold line. The second fold line is oblique relative to the first fold line. The method further can comprise forming an interior of the carton at least partially defined by the plurality of panels. The forming the interior of the carton can comprise forming an open-ended sleeve. Additionally, the method can comprise forming an at least partially closed end of the carton by at least partially overlapping the at least two end flaps.

In another aspect, the disclosure is generally directed to a package comprising a carton and a plurality of articles. The carton can comprise a plurality of panels that extends at least partially around an interior of the carton. The plurality of panels can comprise a bottom panel, a top panel, and a side panel. At least two end flaps can be respectively foldably attached to respective panels of the plurality of panels. The at least two end flaps can at least partially form an at least partially closed end of the carton, and the at least partially closed end can comprise a first portion and a second portion. At least one of the first portion and the second portion can be oblique with respect to the side panel. The plurality of articles can be arranged in a plurality of rows of articles comprising at least a first row generally aligned with the first portion of the at least partially closed end and a second row generally aligned with the second portion of the at least partially closed end. The first row can comprise at least one more article than the second row.

In another aspect, the disclosure is generally directed to a method of forming a carton containing a plurality of articles. The method can comprise obtaining a blank comprising a plurality of panels comprising a bottom panel, a top panel, and a side panel, and at least two end flaps respectively foldably attached to respective panels of the plurality of panels. The method also can comprise forming an interior of the carton at least partially defined by the plurality of panels. The forming the interior of the carton can comprise forming an open-ended sleeve. Further, the method can comprise loading the plurality of articles into the interior of the carton in a plurality of rows of articles comprising at least a first row and a second row. The first row can comprise at least one more article than the second row. Additionally, the method can comprise forming an at least partially closed end of the carton by at least partially overlapping the at least two end flaps. The forming the at least partially closed end can comprise forming a first portion and a second portion of the at least partially closed end so that at least one of the first portion and the second portion is oblique with respect to the side panel and so that the first row is generally aligned with the first portion and the second row is generally aligned with the second portion.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles or aluminum cans) as disposed within the carton embodiments. In this specification, the terms "inner," "outer," "lower," "bottom," "upper," and "top" indicate orientations determined in relation to fully erected and upright cartons.

Figure 1:
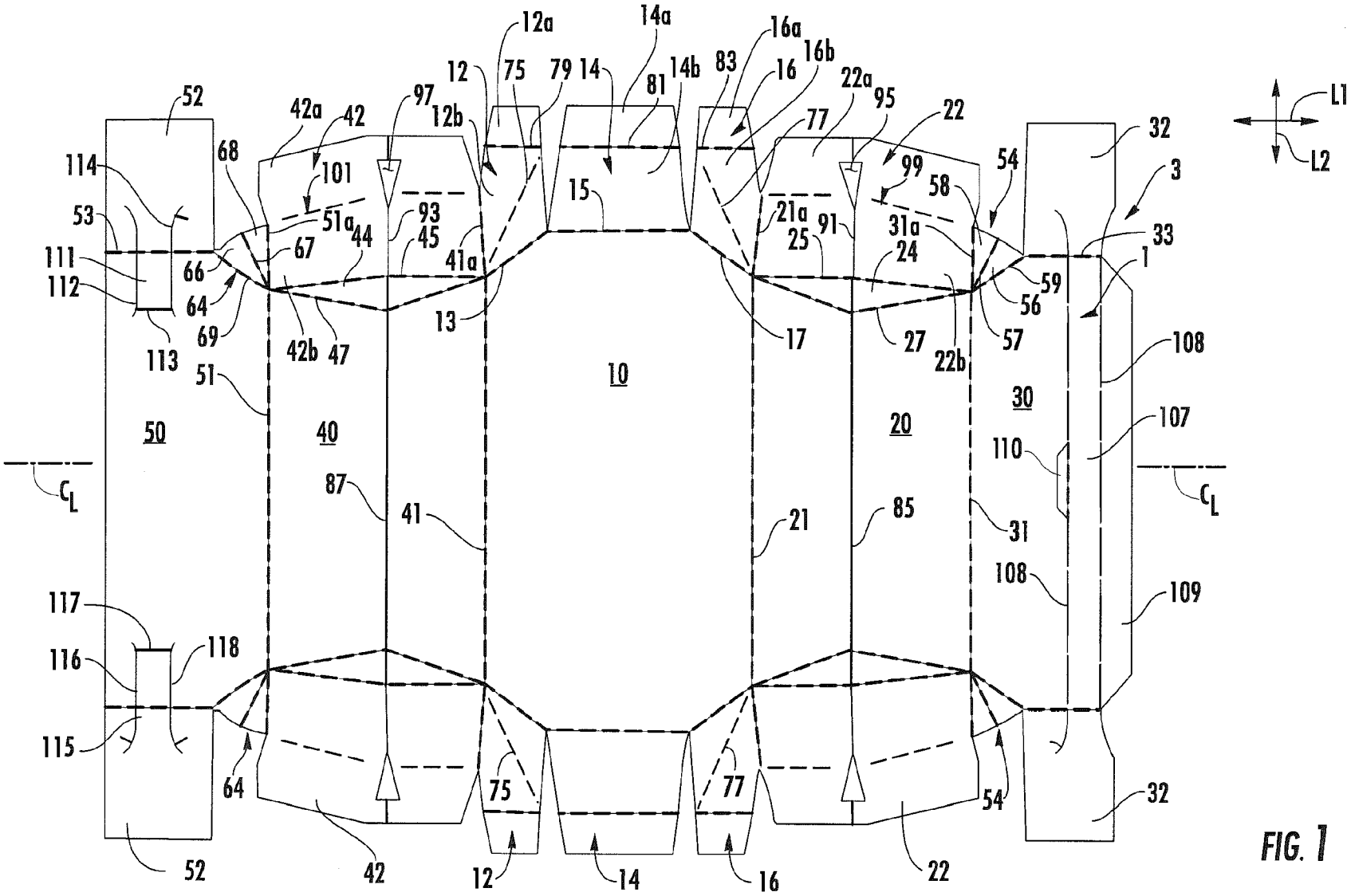
FIG. 1 is a plan view of a blank for forming a carton according to a first embodiment of the disclosure.
Figure 35:
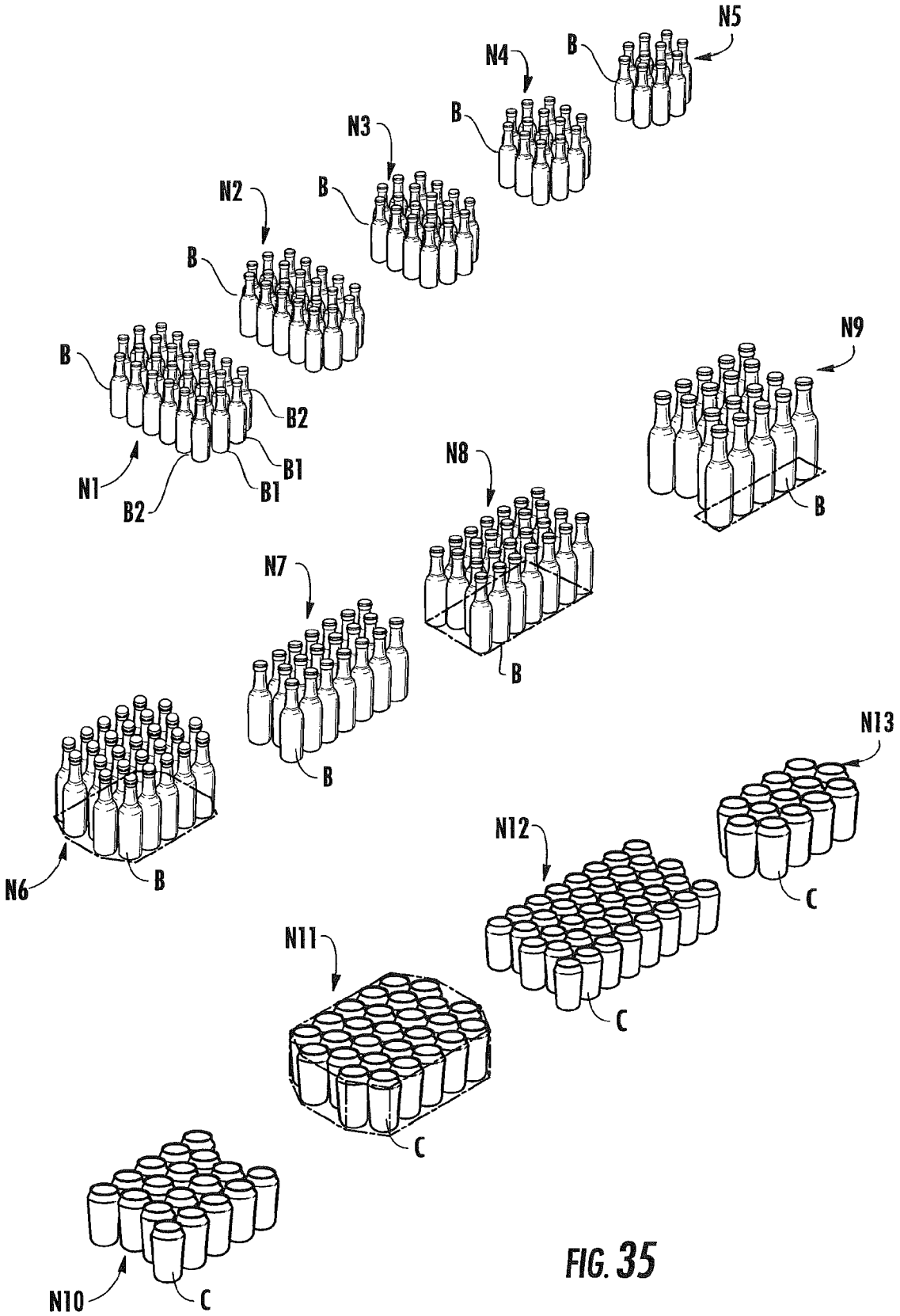
FIG. 35 shows various perspective views of article arrangements that can be used with various embodiments of the disclosure or alternative embodiments of the disclosure.

FIG. 1 is a plan view of the exterior side 1 of a blank, generally indicated at 3, used to form a carton 5 (FIGS. 7 and 8) according to the first exemplary embodiment of the disclosure. The carton 5 can be used to house a plurality of articles such as containers in the form of beverage bottles B (FIG. 35). In the first embodiment, the carton 5 is sized and configured to contain twenty-six bottles B in a single layer in a "nested" arrangement having two outer rows of six bottles per row and two inner rows of seven bottles per row. FIG. 35 shows various nested bottle arrangements that could be used with the first embodiment, or other illustrated and non-illustrated embodiments of the disclosure. The nested arrangement N1 in FIG. 35 is the nested twenty-six pack container configured for the carton 5 of the first embodiment. The carton 5 includes features for facilitating conservation of board material when housing the containers B in a nested arrangement. Additionally, the carton 5 can be more noticeable on a shelf by having a different look than other cartons, in one embodiment.

FIG. 35 shows alternative nested pack arrangement including arrangement N2 with twenty-two bottles B, arrangement N3 with 18 bottles B, arrangement N4 with 14 bottles B, arrangement N5 with 10 bottles, additional arrangements N6-N9 of bottles B, and further arrangements N10-N13 of cans C. The arrangements N1-N5 and/or other arrangements shown and not shown in the illustrated embodiments can be considered "fully nested" arrangements. In one embodiment, a fully nested arrangement of containers can have at least one outer row and at least one inner row, wherein each of the inner row(s) can have at least one more container than an outer row. For example, nested arrangement N1 can have six containers in each of two outer rows and seven containers in each of two inner rows, wherein each of the outer rows is nested with a respectively adjacent inner row. In one embodiment, at least the nesting arrangements N6-N11 can be considered "inverted" or "internal" nesting arrangements since one or more of the interior rows of containers B or C are generally shorter than the outer rows of containers. Other nested or non-nested arrangements of the containers including bottles B or cans C could be provided without departing from the disclosure.

The blank 3 has a longitudinal axis L1 and a lateral axis L2. In the illustrated embodiment, the blank 3 comprises a bottom panel 10 foldably connected to a first side panel 20 at a first lateral fold line 21, a first top panel 30 foldably connected to the first side panel 20 at a second lateral fold line 31, a second side panel 40 foldably connected to the bottom panel at a third lateral fold line 41, and a second top panel 50 foldably connected to the second side panel at a fourth lateral fold line 51.

The bottom panel 10 is foldably connected to a first group of bottom end flaps comprising three bottom end flaps 12, 14, 16 respectively foldably connected to the bottom panel at respective fold lines 13, 15, 17. In one embodiment, the bottom end flaps 12, 16 are corner bottom end flaps that are oblique with respect to the side panels 20, 40 and the bottom end flap 14 when the carton 5 is erected. The first side panel 20 is foldably connected to a first side end flap 22 at a diamond corner panel 24. The diamond corner panel 24 is foldably connected to the side end flap 22 at a fold line 25 and is foldably connected to the side panel 20 at a fold line 27. The first top panel 30 is foldably connected to a first top end flap 32 at a respective fold line 33. Similarly, the second side panel 40 is foldably connected to a second side end flap 42 at a diamond corner panel 44. The diamond corner panel 44 is foldably connected to the side end flap 42 at a fold line 45 and is foldably connected to the second side panel 40 at a fold line 47. The second top panel 50 is foldably connected to a second top end flap 52 at a respective fold line 53. In an alternative embodiment, the diamond corner panels 24, 44 could be omitted. One or more of the bottom end flaps 12, 14, 16, the side end flaps 22, 42, and the top end flaps 32, 52 could be omitted or could be otherwise shaped, arranged, configured, and/or positioned without departing from the disclosure.

In one embodiment, the first top panel 30 is foldably connected to the first side end flap 22 at a gusset 54 that includes a first gusset panel 56 and a second gusset panel 58. The second gusset panel 58 is foldably connected to the first side end flap 22 at a portion 31*a* of the fold line 31 and is foldably connected to the second gusset panel 58 at an oblique fold line 57. The first gusset panel 56 is foldably connected to the first top panel 30 at an oblique fold line 59. Similarly, a gusset 64 foldably connects the second side end flap 42 and the second top panel 50. The second gusset 64 includes first gusset panel 66 and a second gusset panel 68. The first gusset panel 66 is foldably connected to the second side end flap 42 at a portion 51*a* of the fold line 51 and is foldably connected to the second gusset panel 68 at an oblique fold line 67. The second gusset panel 68 is foldably connected to the second top panel 50 at an oblique fold line 69. The gussets 54, 64 could be omitted or could be otherwise shaped, arranged, configured, and/or positioned without departing from the disclosure.

Figure 7:
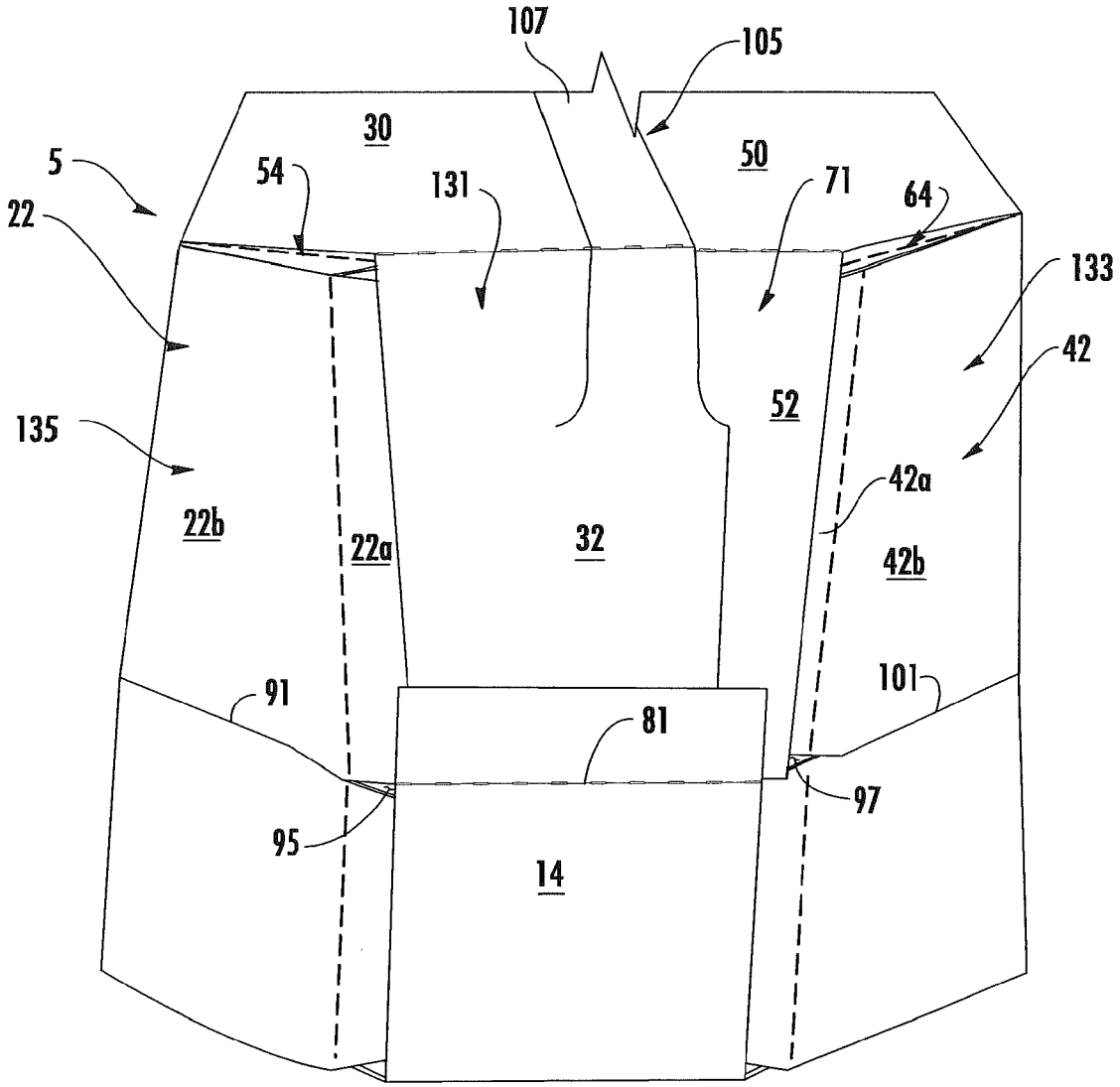
Figure 7A:
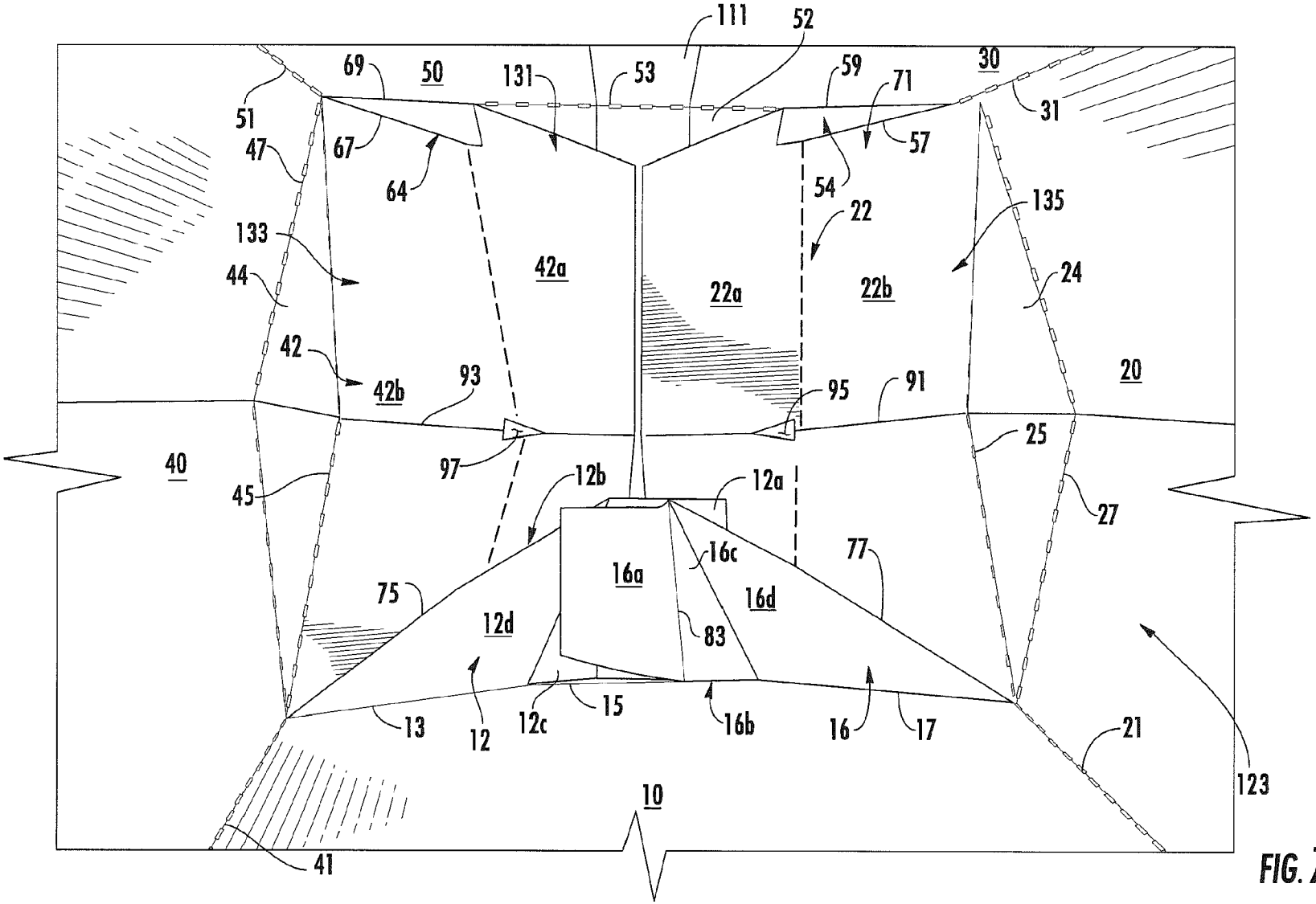
Figure 8:
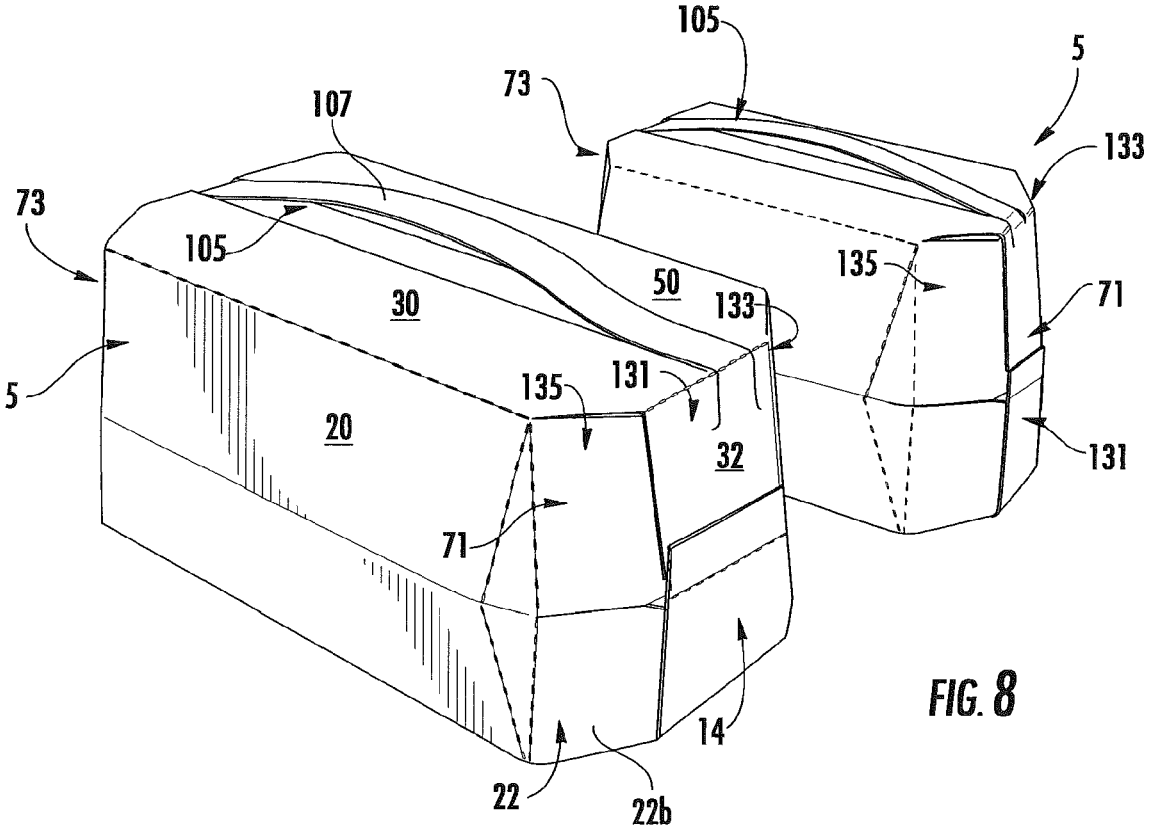
FIG. 8 is a perspective view of the erected carton according to the first embodiment of the disclosure.

In the illustrated embodiment, the blank 3 is generally a mirror-image about its longitudinal centerline CL such that the end flaps 12, 14, 16, 22, 32, 42, 52 and gussets 54, 64 that extend along one marginal area of the blank have similar or identical features at the second marginal area of the blank that are mirror images of the features at the first marginal area of the blank. The end flaps 12, 14, 16, 22, 32, 42, 52 and gussets 54, 64 at the first marginal area 1 of the blank are configured to close a first end 71 of the carton 5 and the end flaps 12, 14, 16, 22, 32, 42, 52 and gussets 54, 64 at the second marginal area of the blank are configured to close a second end 73 of the carton (FIGS. 7, 7A, and 8). One or both of the ends 71, 73 of the carton could be could be otherwise shaped, arranged, configured, and/or positioned without departing from the disclosure.

Figure 2:
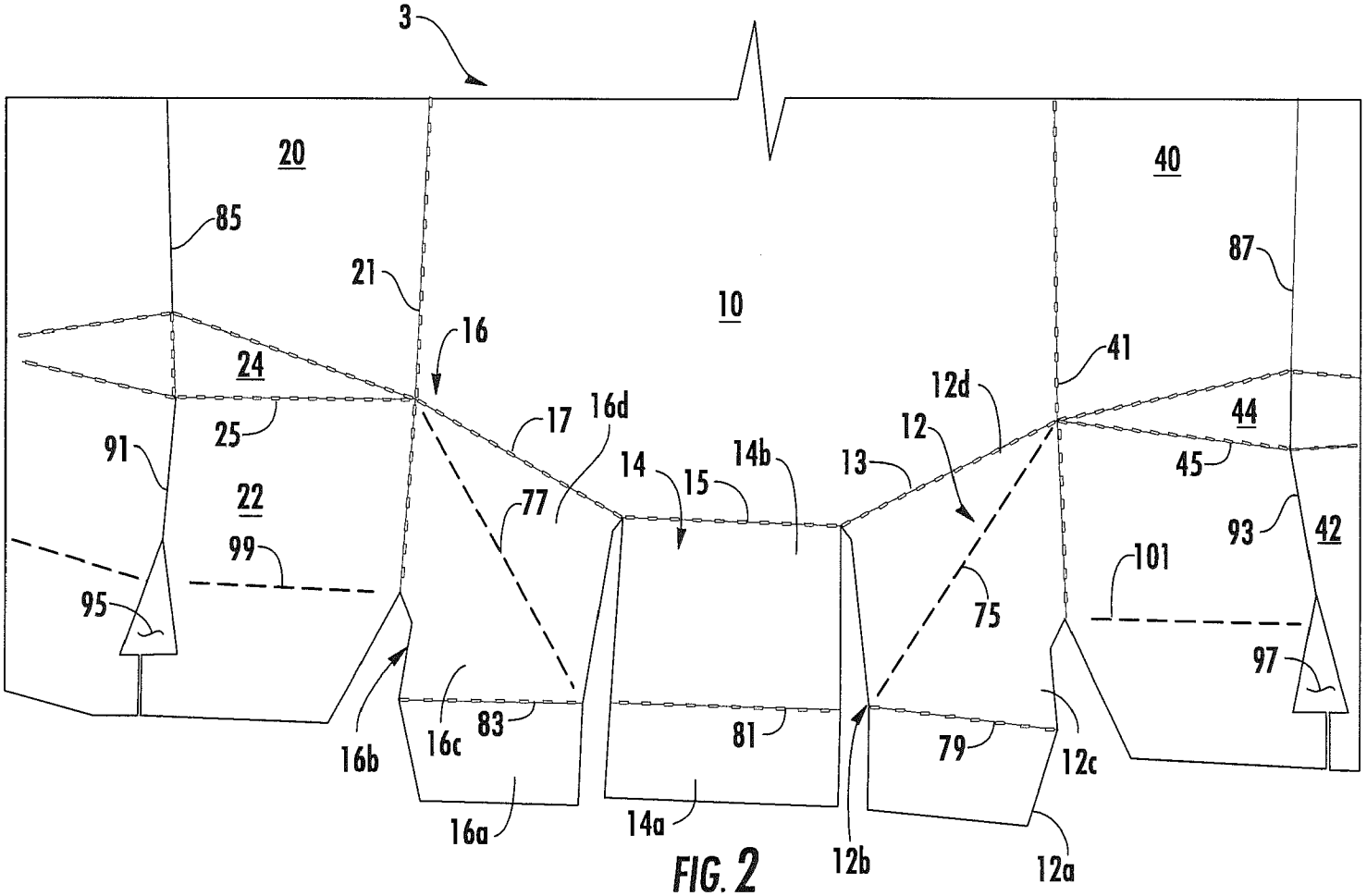
FIG. 2 is a detail view of an end of the blank of FIG. 1 showing the bottom end flaps and the side flaps.

In the illustrated embodiment, the bottom end flaps 12, 16 each have a respective oblique fold line 75, 77 extending at least partially across the end flap. Each of the bottom end flaps 12, 14, 16 has a respective longitudinal fold line 79, 81, 83 extending across the width of the respective bottom end flap to form an outer foldable portion 12*a*, 14*a*, 16*a* and a base portion 12*b*, 14*b*, 16*b* of each respective bottom end flap. As shown in FIG. 2, each of the base portions 12*b*, 16*b* of the respective bottom end flaps 12, 16 comprises a first section 12*c*, 16*c* (e.g., base section) foldably connected to a second section 12*d*, 16*d* (e.g., base section) along the respective fold lines 75, 77. In the illustrated embodiment, the first base sections 12*c*, 16*c* of the respective bottom end flaps 12, 16 are foldably connected to the respective outer portions 12*a*, 16*a* of the respective bottom end flaps 12, 16 along respective longitudinal fold lines 79, 83 and are foldably connected to the respective side end flaps 22, 42 along a respective portion 21*a*, 41*a* of the respective lateral fold lines 21, 41. The second base sections 12*d*, 16*d* of the respective bottom end panels 12, 16 are foldably connected to the bottom panel 10 along the respective oblique fold lines 13, 17. The outer portion 14*a* is foldably connected to the base portion 14*b* of the bottom end flap 14 along the longitudinal fold line 81, and the base portion 14*b* of the bottom end flap 14 is foldably connected to the bottom panel 10 along the fold line 15. Each of the side end flaps 22, 42 has a fold line 99, 101 extending across a respective portion of the side end flap 22, 42 to at least partially define an outer foldable portion 22*a*, 42*a* and a base portion 22*b*, 42*b* of each side end flap. The outer foldable portions 22*a*, 42*a* are foldably connected to the respective base portions 22*b*, 42*b* and the base portions are foldably connected to the respective diamond corner panel 24, 44. Any of the bottom end flaps 12, 14, 16 and the side end flaps 22, 42 could be omitted or could be otherwise shaped, arranged, configured, and/or positioned without departing from the disclosure.

As shown in FIG. 1, each of the side panels 20, 40 includes a respective lateral fold line 85, 87 extending across each respective side panel and across a respective adjacent diamond corner panel 24, 44. In the illustrated embodiment, each of the side end flaps 22, 42 includes a respective cut 91, 93 extending from a respective fold line 85, 87. The cuts 91, 93 are aligned with an opening 95, 97 in a respective side end flap 22, 42. The cuts 91, 93 and openings 95, 97 divide each of the side end flaps 22, 42 into two portions that are independently foldable relative to the other at respective portions of the fold lines 25, 45 connecting the side end flaps to a respective diamond corner panel 24, 44. One or more of the fold lines 75, 77, 79, 81, 83, 85, 87, the cut lines 91, 93, and the openings 95, 97 could be omitted without departing from the disclosure.

In one embodiment, the first top panel 30 and the second top panel 50 have handle features for forming a handle 105 in the carton 5 (FIGS. 7, 7A, and 8). As show in FIG. 1, the handle features include a first handle panel 107 extending in the first top panel 30 and into the top end flaps 32, a handle reinforcement flap 109 foldably connected to the first handle panel 107, a second handle panel 111 foldably connected to the second top panel 50 at a fold line 113 and extending into the first top end flap 52, and a third handle panel 115 foldably connected to the second top panel 50 at a fold line 117 and extending into the second top end flap 52. The first handle panel 107 can be separable from the first top panel 30 and the top end flaps 32 along cut or tear lines 108 (e.g., cuts with nicks spaced therealong). The second handle panel 111 can be separable from the second top panel 50 and the first top end flap 52 along two cuts 112, 114, and the third handle panel 115 can be separable from the second top panel 50 and the second top end flap 52 along two cuts 116, 118. When the carton 5 is erected, the first handle panel can at least partially overlap and/or can be at least partially glued to the second and third handle panels 111, 115 to form the handle 105. In one embodiment, the handle 105 can be actuated by grasping the first handle panel 107 at an access feature 110 and pulling upwardly on the first handle panel 107. The handle 105 and handle features could be omitted or could be otherwise shaped, arranged, configured, and/or positioned without departing from the disclosure.

Figure 3:
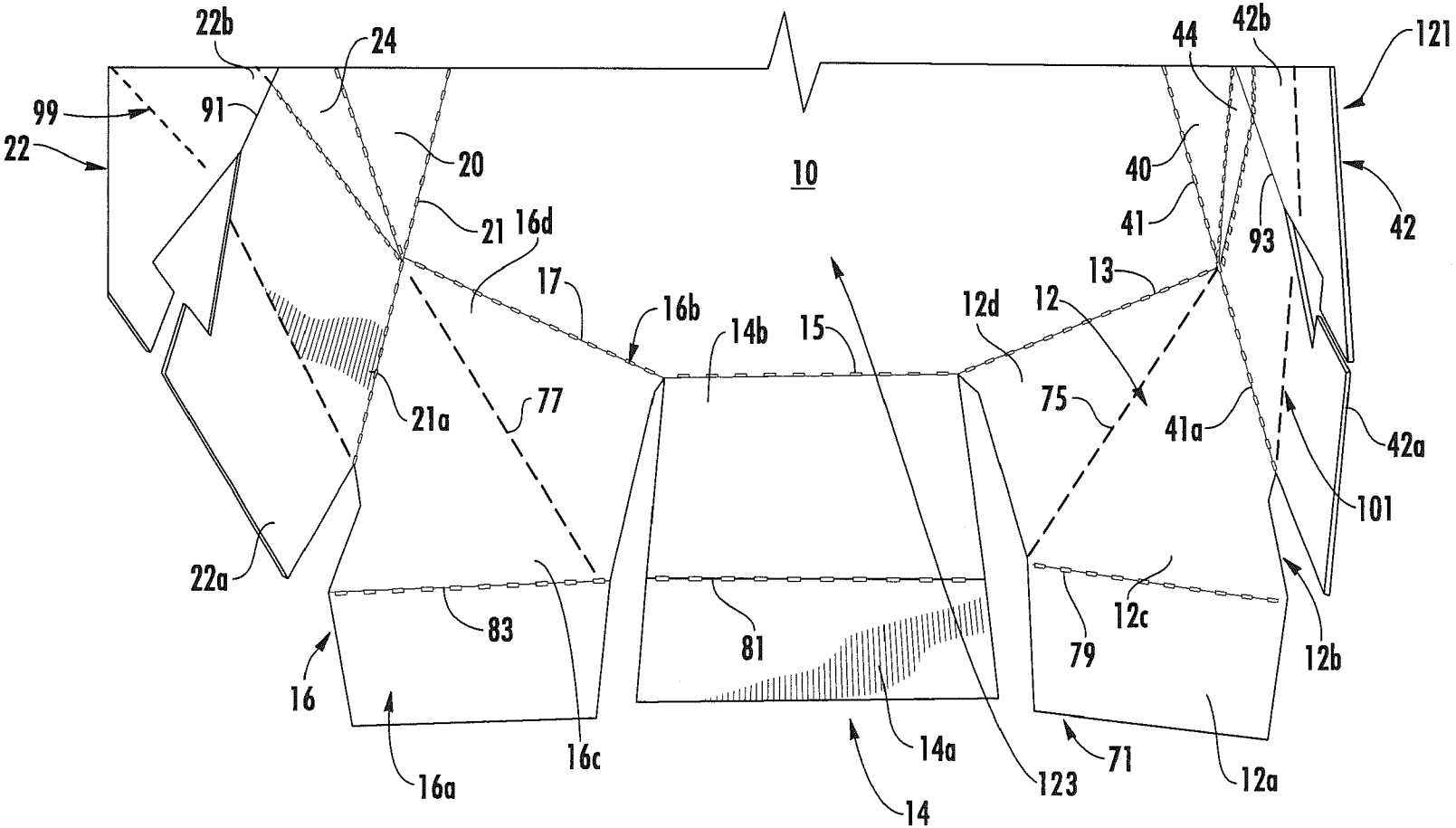
FIGS. 3-7A are perspective views showing the formation of the carton from the blank of FIG. 1 according to the first embodiment of the disclosure.
Figure 4:
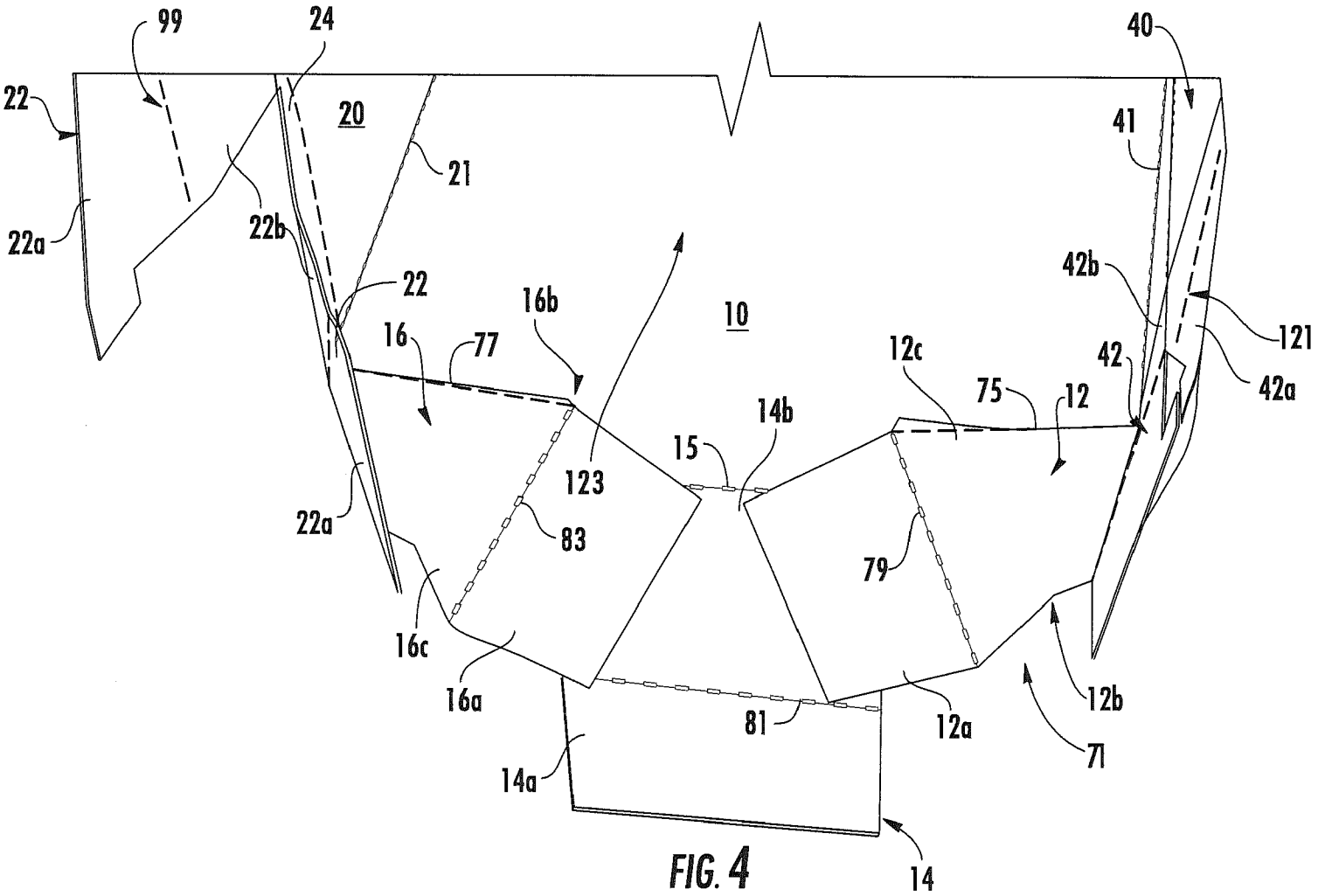
Figure 5:
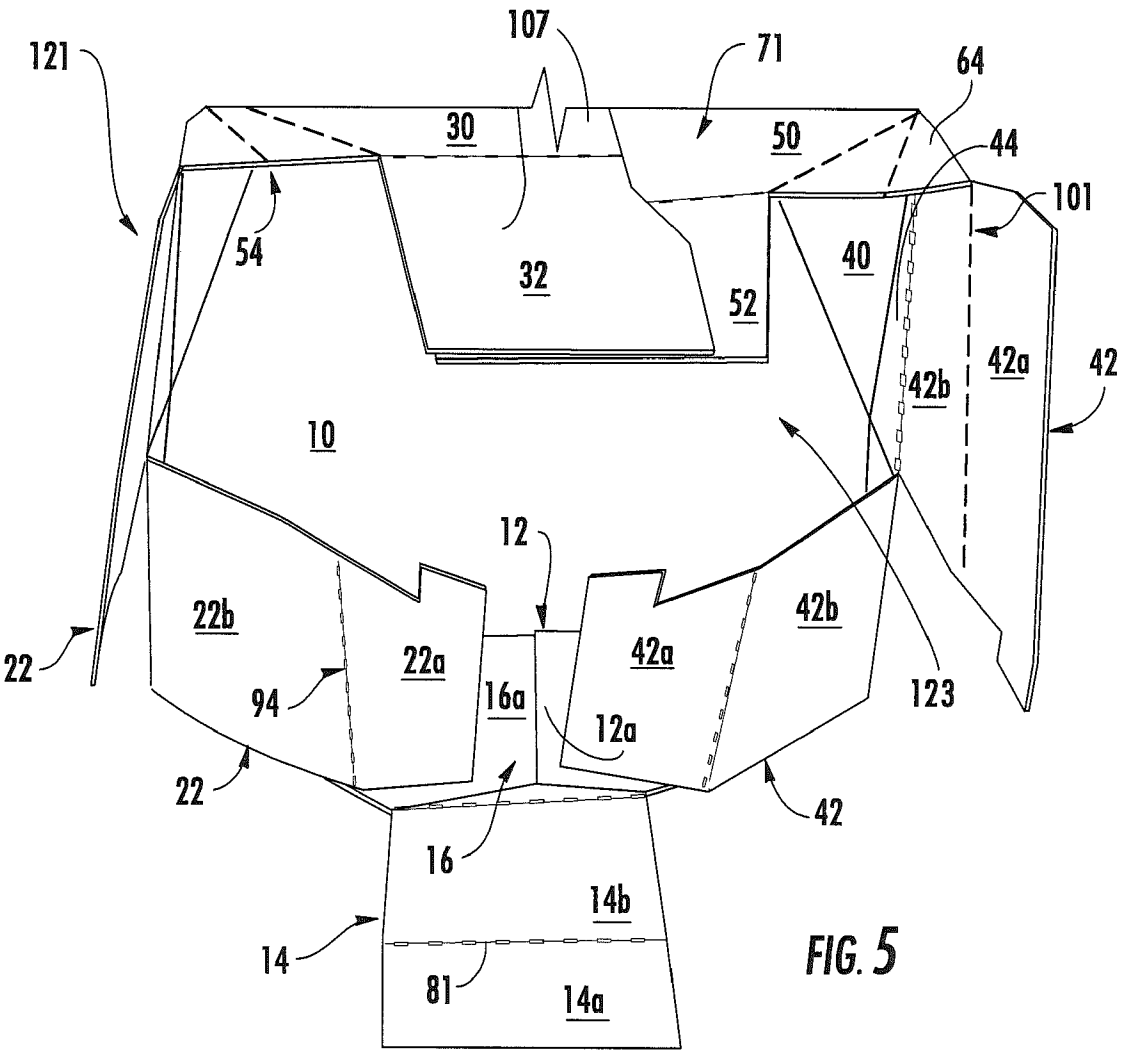
Figure 6:
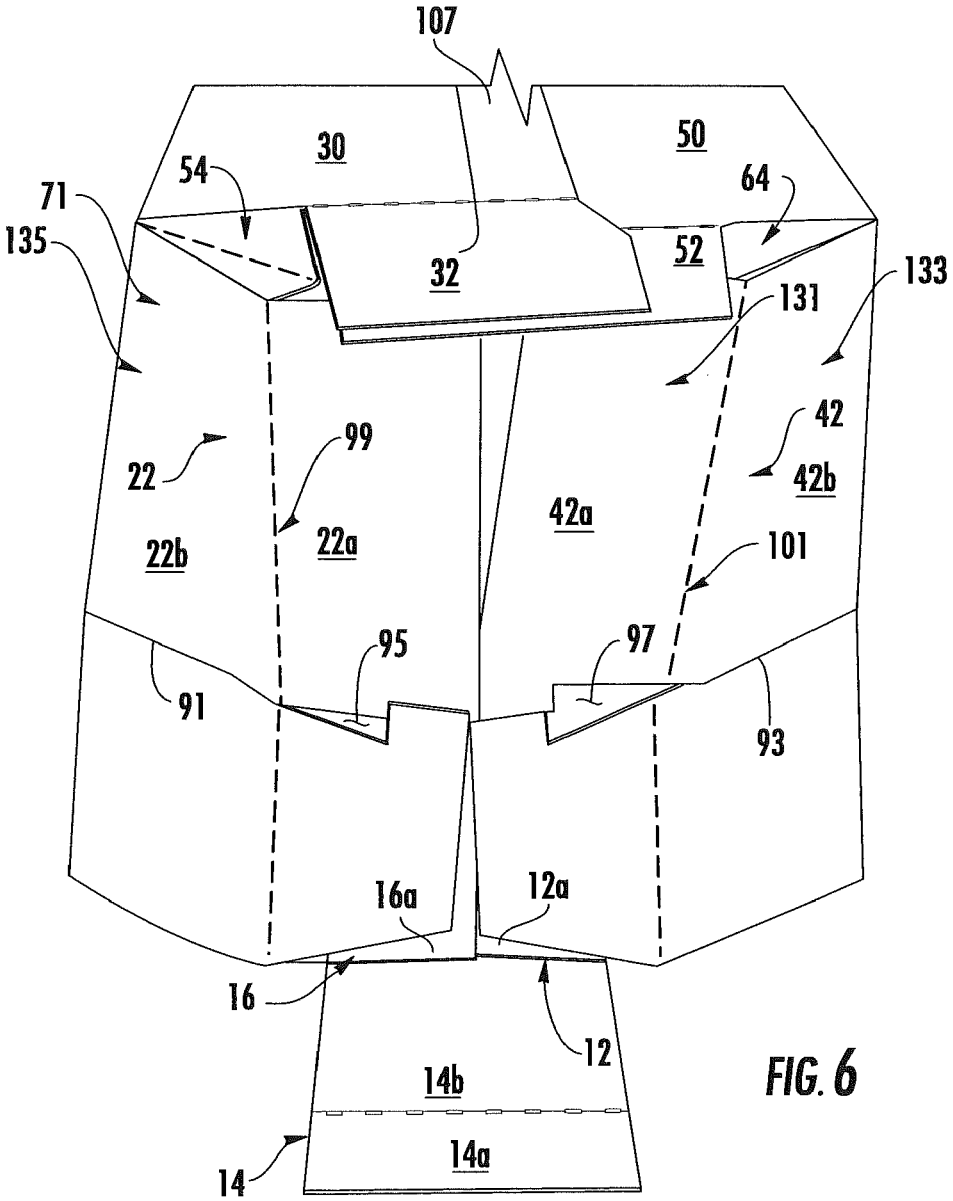

FIGS. 3-8 show various features and steps of one exemplary method of forming the carton 5 from the blank 3. As shown in FIG. 3, the side panels 20, 40 are positioned relative to the bottom panel 10 and the first top panel 30 and second top panel 50 are overlapped (FIG. 5) to form an open-ended sleeve 121 (FIGS. 3-5). In the illustrated embodiment, at least a portion of the interior surface of the first top panel 30 is glued to at least a portion of the exterior surface of the second top panel 50. The handle reinforcement panel 109 can be folded along the tear line 108 into face-to-face contact with the first handle panel 107. The handle reinforcement panel 109 can be glued to the handle panel 107 in one embodiment. Alternatively, the handle reinforcement handle 109 could remain planar with the remainder of the first top panel 30 and can be glued to the exterior surface of the second top panel 50. The top end flap 32 can overlap and/or be glued to the top end flap 52 (FIGS. 5-7). In one embodiment, the containers B are grouped together and loaded into the open-ended sleeve 121 in the nested configuration N1 shown in FIG. 35. One of the ends 71, 73 can be closed prior to loading the containers B or the ends can remain open during loading of the containers without departing from the disclosure. Further, the containers B could be arranged in a different nesting configuration (e.g., nesting configurations N1-N9 or any other suitable nesting configuration).

As shown in FIGS. 3-7, the closing of one of the ends 71 of the carton 5 is shown and will be described, but the closing of the other end 73 can be identical to the end 71 described herein. Alternatively, the end 73 can have other features and/or could have other closing steps without departing from the disclosure. As shown in FIG. 4, the bottom end flaps 12, 16 are inwardly folded about fold lines 13, 17 by folding each end flap 12, 16 at a respective oblique fold line 75, 77 so that each oblique fold line is raised. In the illustrated embodiment, the base portions 12*b*, 16*b* of the respective bottom end flaps 12, 16 are folded along the oblique fold lines 75, 77 so that the base sections 12*c*, 16*c* overlap the respective base sections 12*d*, 16*d* of the respective bottom end flaps 12, 16. In one embodiment, the outer portions 12*a*, 16*a* of the respective bottom end flaps 12, 16 can be at least partially overlapped with respect to one another and can be generally aligned with the longitudinal fold line 15 (FIG. 5). Each adjacent side flap 22, 42 is folded inward by the foldable connection with a respective bottom end flap 12, 16 at the portions 21*a*, 41*a* of fold lines 21, 41. When the adjacent side end flaps 22, 42 are folded inward, the portion 21*a*, 41*a* of the fold line 21, 41 connecting a respective side end flap to a respective bottom end flap 12, 16 is brought in an overlapping or closely adjacent relationship with the oblique fold line 13, 17 connecting a respective bottom end flap to the bottom panel 10 (FIG. 5). The bottom portions of the side end flaps 22, 42 below the cuts 91, 93 can be adhesively connected to the inwardly folded bottom end flaps 12, 16 to partially close a bottom portion of the end 71 of the carton 5. In one embodiment, the base portions 22*b*, 42*b* of the respective side end flaps 22, 42 can be glued to the respective base sections 12*c*, 16*c* of the respective bottom end flaps 12, 16.

Next, the upper portions of the side end flaps 22, 42 can be inwardly folded to the position shown in FIG. 6 to further close the end 71 of the carton 5. Alternatively, the upper and lower portions of the side end flaps 22, 42 can be closed at the same time. As the upper portion of the side end flap 22 is folded inwardly, the gusset 54 can fold inwardly into the interior 123 of the open-ended sleeve 121 along fold lines 57, 59 and along portion 31*a* of fold line 31. Similarly, as the upper portion of the side end flap 42 is folded inwardly, the gusset 64 can fold inwardly into the interior 123 of the open-ended sleeve 121 along fold lines 67, 69 and along portion 51*a* of fold line 51. In one embodiment, either of the gussets 54, 64 can be folded against the respective top panels 30, 50 or the respective side end flaps 22, 42. The overlapped top end flaps 32, 52 can be downwardly folded from the position of FIG. 6 and the bottom end flap 14 can be upwardly folded to partially overlap the downwardly folded top end flaps (FIG. 7). Glue or other adhesive can be used to secure the bottom end flap 14 and the top end flaps 32, 52. Further, the outwardly foldable portions 12*a*, 16*a* of the bottom end flaps 12, 16 can be overlapped and secured to the outwardly foldable portions 22*a*, 42*a* of the side end flaps 22, 42. Additionally, the top end flaps 32, 52 can be glued to one or more of the outer portions 22*a*, 42*a* of the side end flaps 22, 42, and the bottom end flap 14 can be glued to one or more of the outer portions 22*a*, 42*a* of the side end flaps 22, 42 and the outer portions 12*a*, 16*a* of the bottom end flaps 12, 16. The ends 71, 73 could be closed by other forming or folding steps as described herein without departing from the disclosure. For example, the top end flaps 32, 52 can at least partially overlap the bottom end flap 14 in an alternative embodiment.

As shown in FIGS. 7, 7A, and 8, the ends 71, 73 of the carton 5 have a central portion 131 that is generally perpendicular to the side panels 20, 40 and is generally aligned with the fold lines 15, 33, 53. The ends 71, 73 have two oblique side portions 133, 135 on a respective side of the central portion 131 that are respectively aligned with the fold lines 13, 17. The central portion 131 can comprise the overlapped top end flaps 32, 52, the central bottom end flap 14, some or all of the outer portions 12*a*, 16*a* of the bottom end flaps 12, 16, and the outer portions 42*a*, 22*a* of the side end flaps 42, 22. In one embodiment, the central portion 131 can include some of the base portions 12*b*, 16*b* (including portions of the base sections 12*c*, 16*c* and/or 12*d*, 16*d*). The oblique side portions 133, 135 can include respective base portions 42*b*, 22*b* of the side end flaps 22, 42 and the base portions 12*b*, 16*b* (with the respectively overlapped base sections 12*c*, 12*d* and 16*c*, 16*d*). In the illustrated embodiment, the configuration of the ends 71, 73 with central portion 131 and oblique side portions 133, 135 facilitates receiving the nested arrangement N1 (FIG. 35) of containers B. In one embodiment, the nested arrangement N1 includes two end containers B1 (FIG. 35) in the two middle rows of containers that are positioned to be adjacent the central portion 131 of an end 71, 73 of the carton 5, and two end containers B2 of a respective outer row of containers that are positioned to be adjacent a respective oblique side portion 133, 135 of the ends 71, 73. Either of the ends 71, 73 of the carton 5 could be otherwise shaped, arranged, positioned, and/or configured without departing from the disclosure, and the nested arrangement N1 could be an alternative nested arrangement (e.g., nested arrangement N2-N9, or a nested arrangement that is otherwise configured) without departing from the disclosure.

Figure 9:
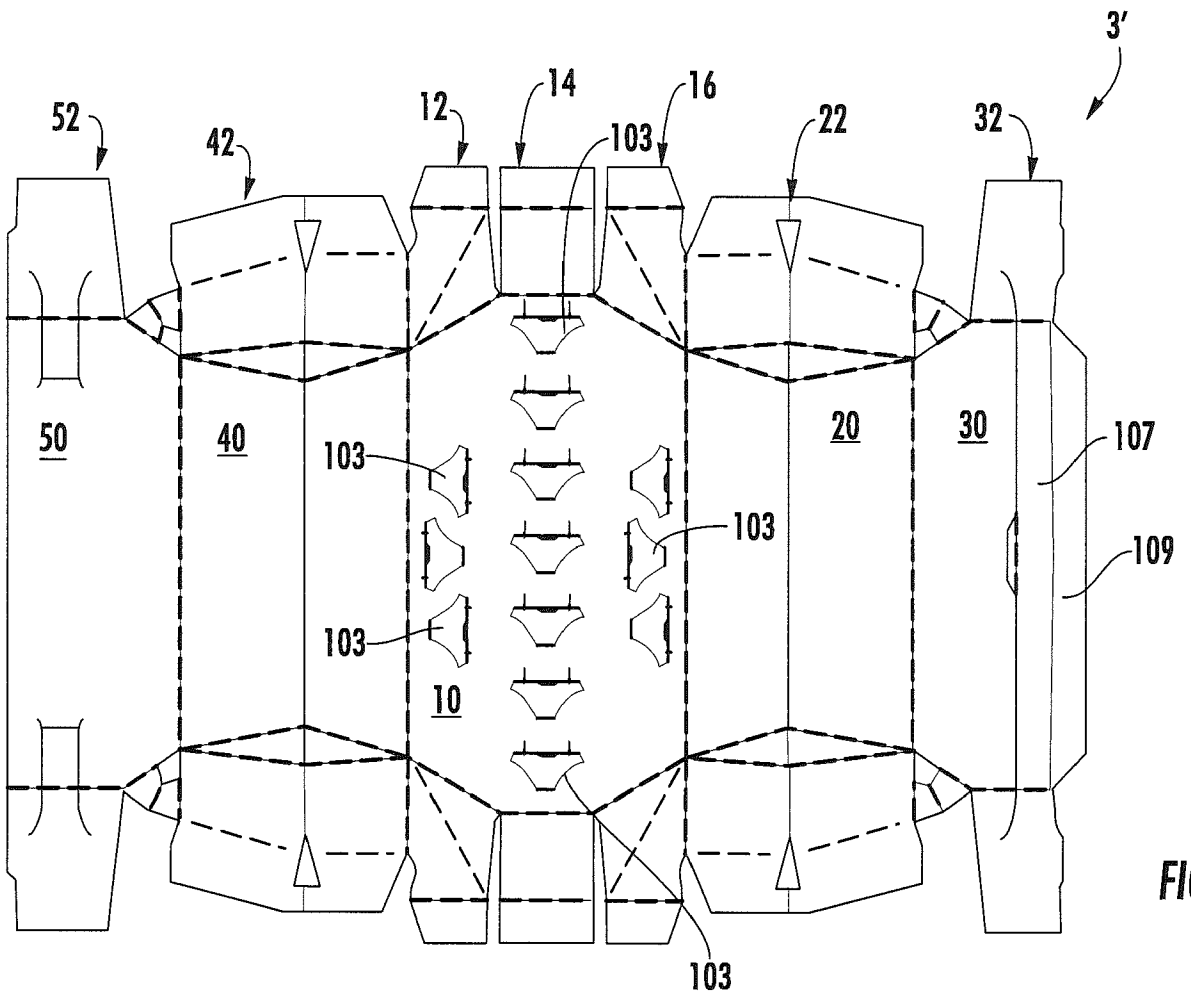
FIG. 9 is a plan view of a blank for forming a carton according to a second embodiment of the disclosure.

FIG. 9 is a plan view of a blank 3' for forming a carton (not shown) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. The blank 3' has article protection flaps 103 in the bottom panel 10. The article protection flaps 103 are for being upwardly folded relative to the bottom panel 10 to be located between adjacent containers B in the nested arrangement N1. The article protection flaps 103 protect the containers B by providing cushioning between adjacent containers that reduces breakage of the containers. In one embodiment, the article protection flaps 103 and/or other article protection features can be similar or identical to the features described in any of the embodiments disclosed in U.S. patent application Ser. No. 13/419,740, which was filed on Mar. 14, 2012, U.S. patent application Ser. No. 13/768,079, which was filed on Feb. 15, 2013, and U.S. patent application Ser. No. 13/833,542, which was filed on Mar. 15, 2013, the disclosures of which are hereby incorporated by reference for all purposes as if presented herein in their entirety. The article protection flaps 103 could be otherwise shaped, arranged, positioned, and/or configured without departing from the disclosure.

Figure 10:
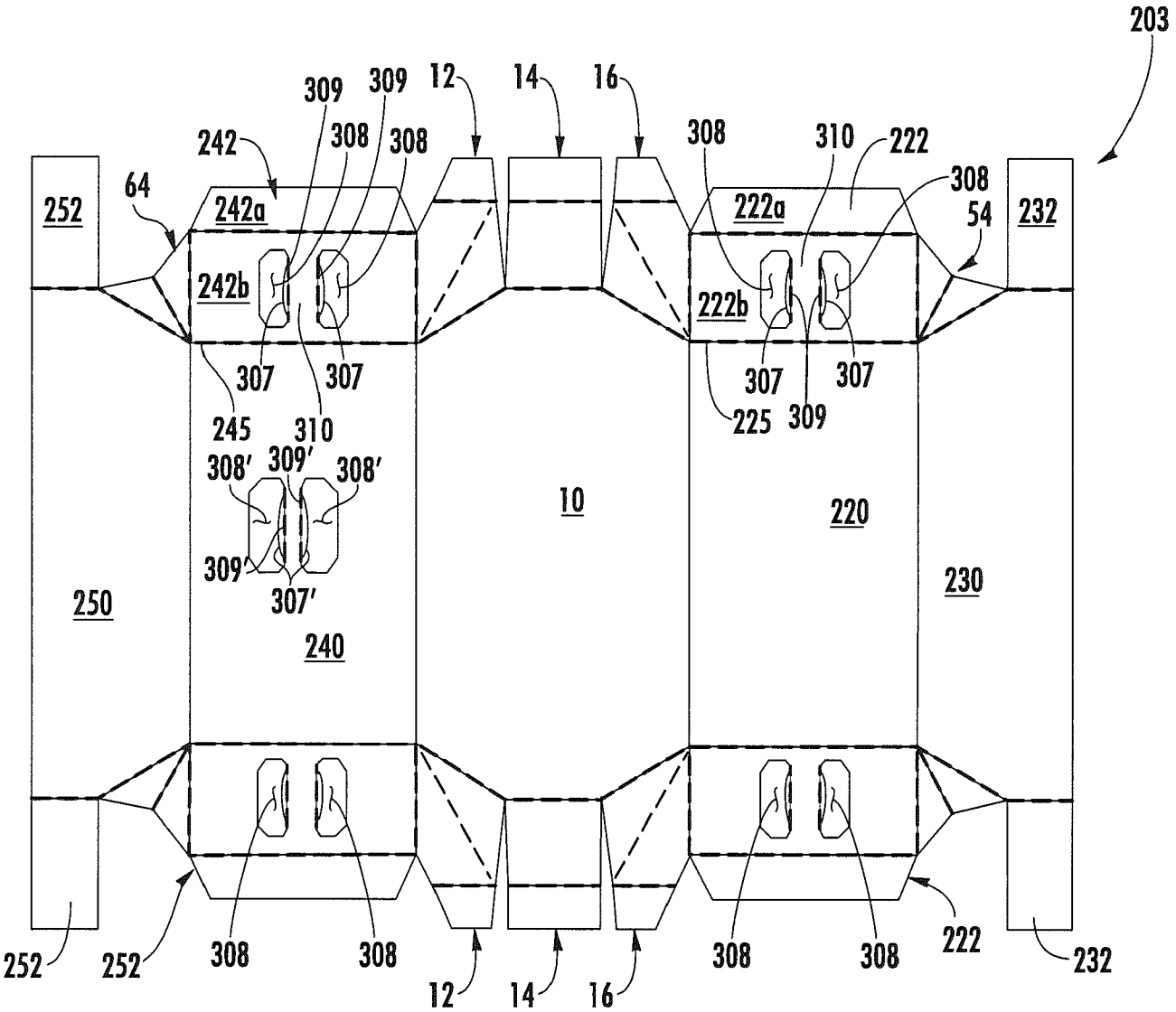
FIG. 10 is a plan view of a blank for forming a carton according to a third embodiment of the disclosure.

FIG. 10 is a plan view of a blank 203 for forming a carton 205 (FIG. 11) of a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. The blank 203 includes handle openings 308 in the side end flaps 222, 242 for forming handles 305 (FIG. 11) in both ends 271, 273 of the carton. A handle flap 307 can be foldably connected to respective grip portions 310 of the respective side end flaps 222, 242 along respective lateral fold lines 309 adjacent each of the handle openings 308. As shown in FIG. 10, the side end flaps 222, 242 can be foldably connected to the respective side panels 220, 240 along respective longitudinal fold lines 225, 245, and each of the side end flaps 222, 242 can include an outer portion 222*a*, 242*a* foldably connected to a respective base portion 222*b*, 242*b*. In the illustrated embodiment, the handle openings 308 can be disposed in the base portions 222*b*, 242*b* of the side end flaps 222, 242. In an alternative embodiment, the diamond corner panels 24, 44 of the first embodiment could be included. As shown in FIG. 10, the cuts 91, 93 and openings 95, 97 in the respective side end flaps 22, 42 of the first embodiment can be omitted in the side end flaps 222, 242, and the lateral fold lines 85, 87 in the side panels 20, 40 can be omitted in the side panels 220, 240. Alternatively, any of the cuts 91, 93, the openings 95, 97, and the fold lines 85, 87 could be included in the blank 203.

Figure 11:
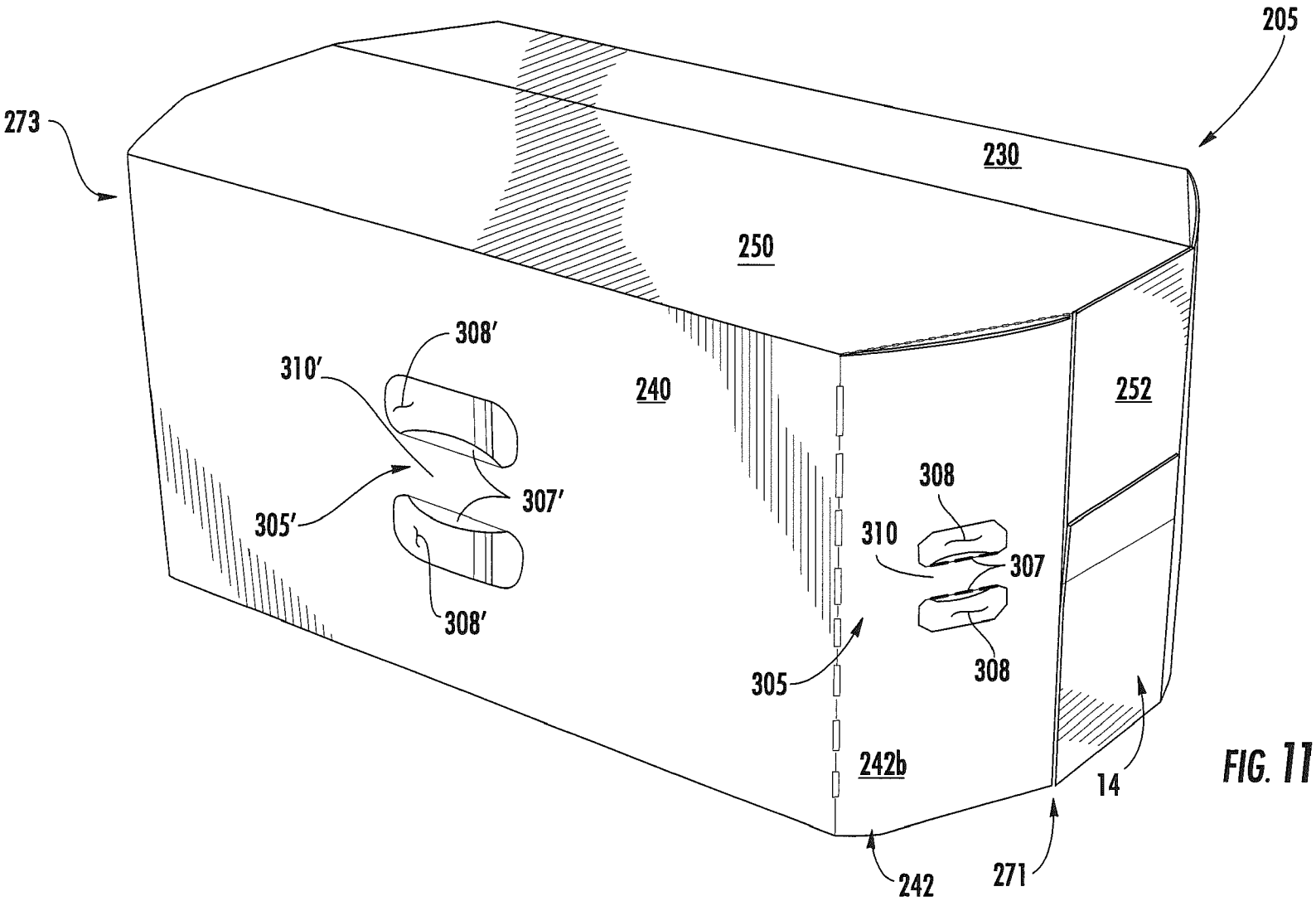
FIG. 11 is a perspective view of a carton formed from the blank of FIG. 10 according to the third embodiment of the disclosure.

As shown in FIGS. 10 and 11, the blank 203 can include handle features in the second side panel 240 for forming a handle 305' in the carton 205. The handle features can include handle openings 308' in the second side panel 240 (and/or in any of the panels 10, 220, 230, 250). Handle flaps 307' are foldably connected to a grip portion 310' of the second side panel 240 along respective lateral fold lines 309'. Any of the handle openings 308, 308' and/or handle flaps 307, 307' could be omitted or could be otherwise shaped, arranged, configured, and/or positioned without departing from the disclosure. For example, the blank 203 and the carton 205 could omit the handle openings 308' and the handle flaps 307' and/or one or more of the handle openings 308 and handle flaps 307.

Figure 12:
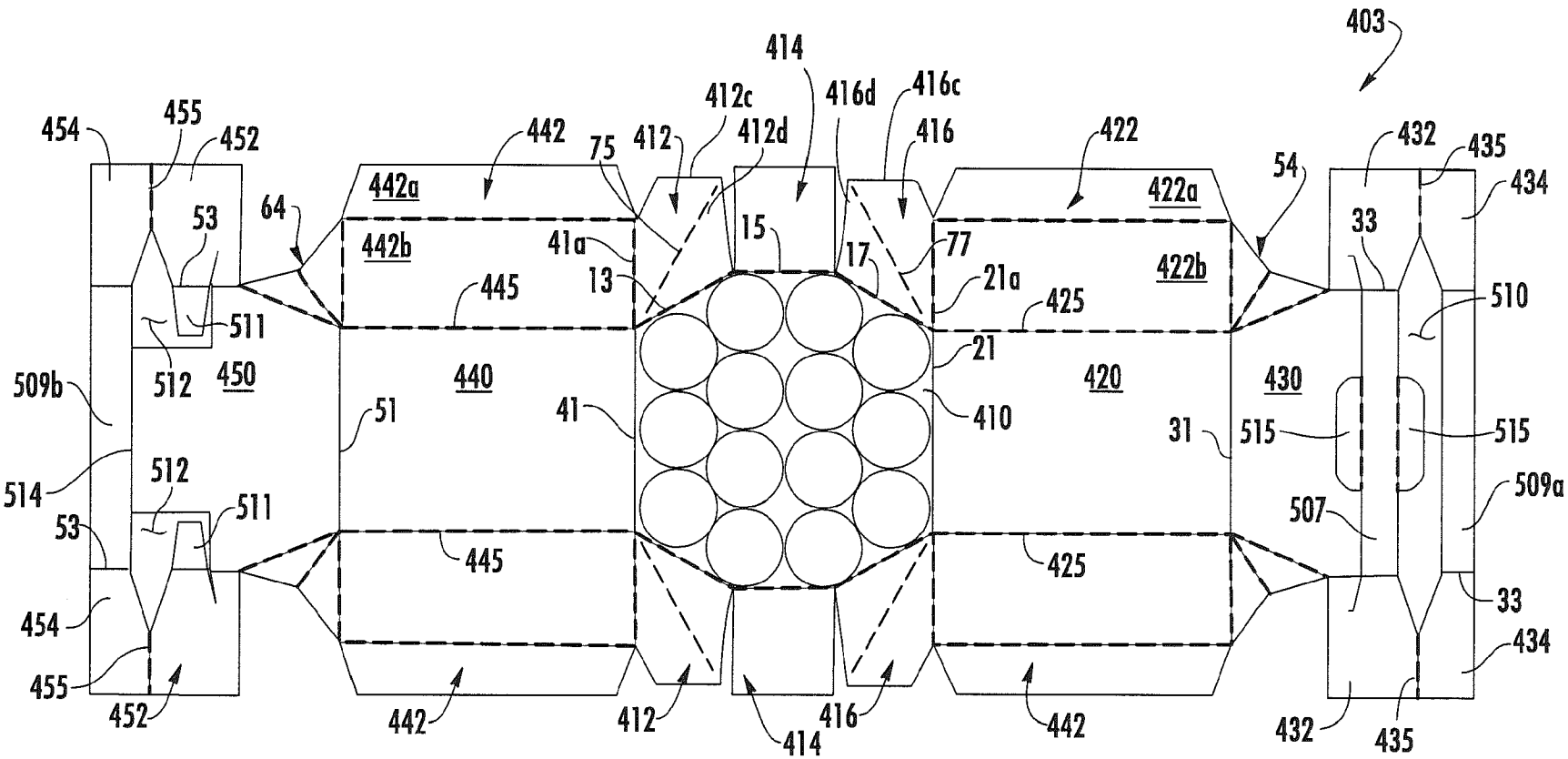
FIG. 12 is a plan view of a blank for forming a carton according to a fourth embodiment of the disclosure.

FIGS. 12-16 illustrate a fourth embodiment of the disclosure that includes a carton 405 formed from a blank 403. The fourth embodiment is generally similar to the first embodiment, except for variations noted and variations that will be apparent to one of ordinary skill in the art. Accordingly, similar or identical features of the embodiments have been given like or similar reference numbers. In the fourth embodiment, the blank 403 and the carton 405 are configured to contain fourteen containers B in the nested arrangement N4 shown in FIG. 35. In the embodiment of FIG. 12, the blank 403 does not have diamond corner panels 24, 44 (FIG. 1), so side end flaps 422, 442 are foldably connected to a respective side panel 420, 440 at a longitudinal fold line 425, 445. In an alternative embodiment, the diamond corner panels 24, 44 could be included in the blank 403. In the illustrated embodiment, each of the side end flaps 422, 442 can include an outer portion 422*a*, 442*a* foldably connected to a base portion 422*b*, 442*b*. As shown in FIG. 12, the cuts 91, 93 and openings 95, 97 in the respective side end flaps 22, 42 of the first embodiment can be omitted in the side end flaps 422, 442, and the lateral fold lines 85, 87 in the side panels 20, 40 can be omitted in the side panels 420, 440. Alternatively, any of the cuts 91, 93, the openings 95, 97, and the fold lines 85, 87 could be included in the blank 403.

As shown in FIG. 12, the bottom panel 410 can be foldably connected to bottom end flaps 412, 416 along oblique fold lines 13, 17 and to a bottom end flap 414 along a longitudinal fold line 15. The bottom end flaps 412, 414, 416 are generally similar to the bottom end flaps 12, 14, 16 of the first embodiment (FIG. 1) except the outer portions 12*a*, 14*a*, 16*a* are omitted in the bottom end flaps 412, 414, 416. The bottom end flaps 412, 416 include a respective first base section 412*c*, 416*c* foldably connected to a respective second base section 412*d*, 416*d* along the respective oblique fold lines 75, 77.

As shown in FIG. 12, the first top panel 430 and the second top panel 450 of the blank 403 have alternative features for forming the handle 505. The handle features can include a handle panel 507 that is separable from the first top panel 430 along a cut or tear line 508 and that extends into the top end flaps 432. A first handle reinforcement flap 509*a* is foldably connected to reinforcing end flaps 434, which are foldably connected to the respective top end flaps 432 along lateral fold lines 435. An opening 510 can extend between the handle panel 507 and the first handle reinforcement flap 509*a*. Inner handle panels 511 can extend from the second top end flaps 452 adjacent respective openings 512 in the second top panel 450, and a second handle reinforcement panel 509*b* is foldably connected to reinforcing end flaps 454, which are foldably connected to the respective top end flaps 452 along lateral fold lines 455. As shown in FIG. 12, the second handle reinforcement flap 509*b* is separable from the second top panel 450 along a cut or tear line 514. The handle features can include two handle flaps 515 foldably connected to the first handle panel 507 along respective lateral fold lines. One or more of the handle features could be omitted or could be otherwise shaped, arranged, positioned, and/or configured without departing from the disclosure.

Figure 13:
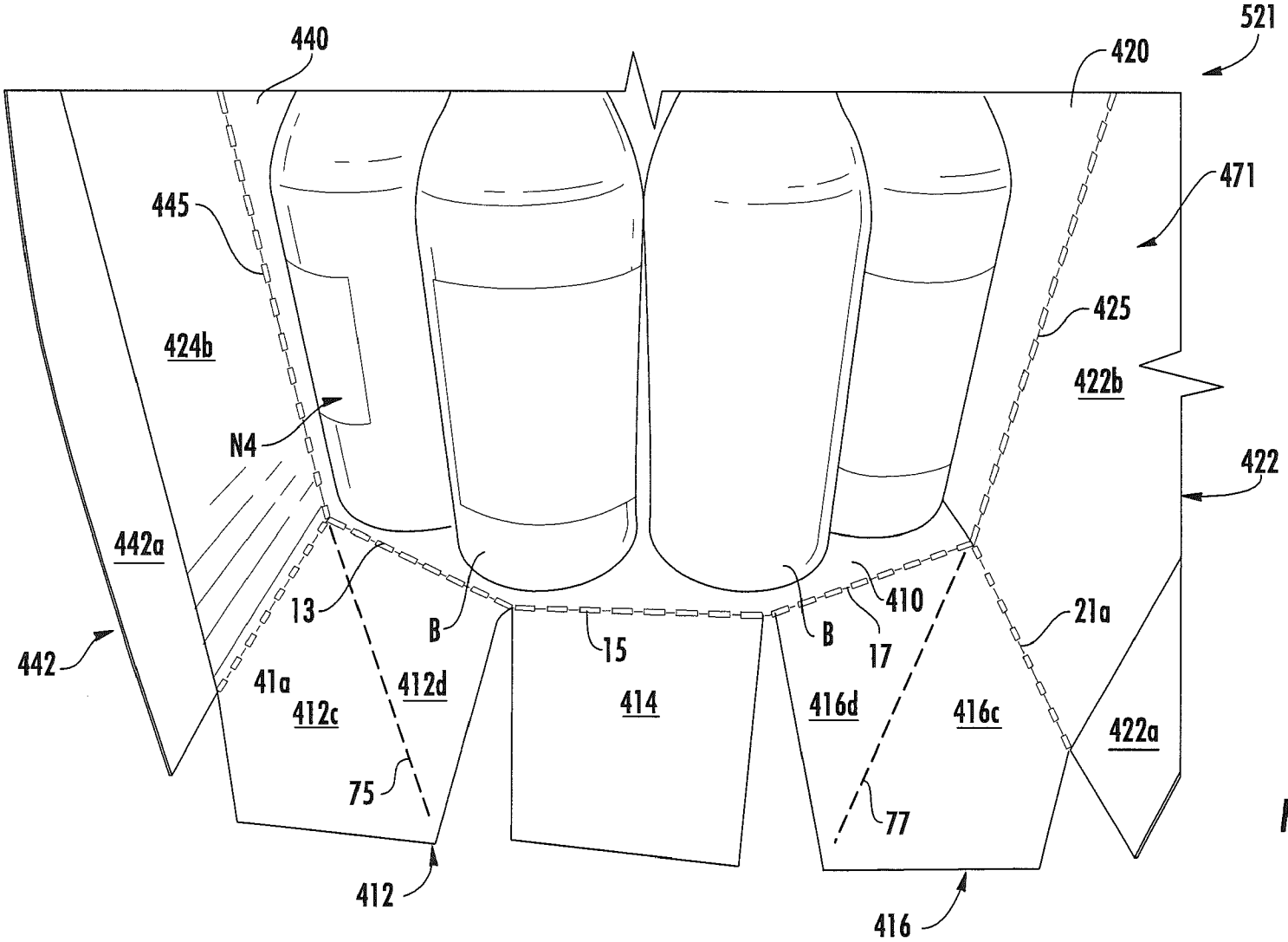
FIGS. 13 and 14 are perspective views showing the formation of the carton from the blank of FIG. 12 according to the fourth embodiment of the disclosure.
Figure 14:
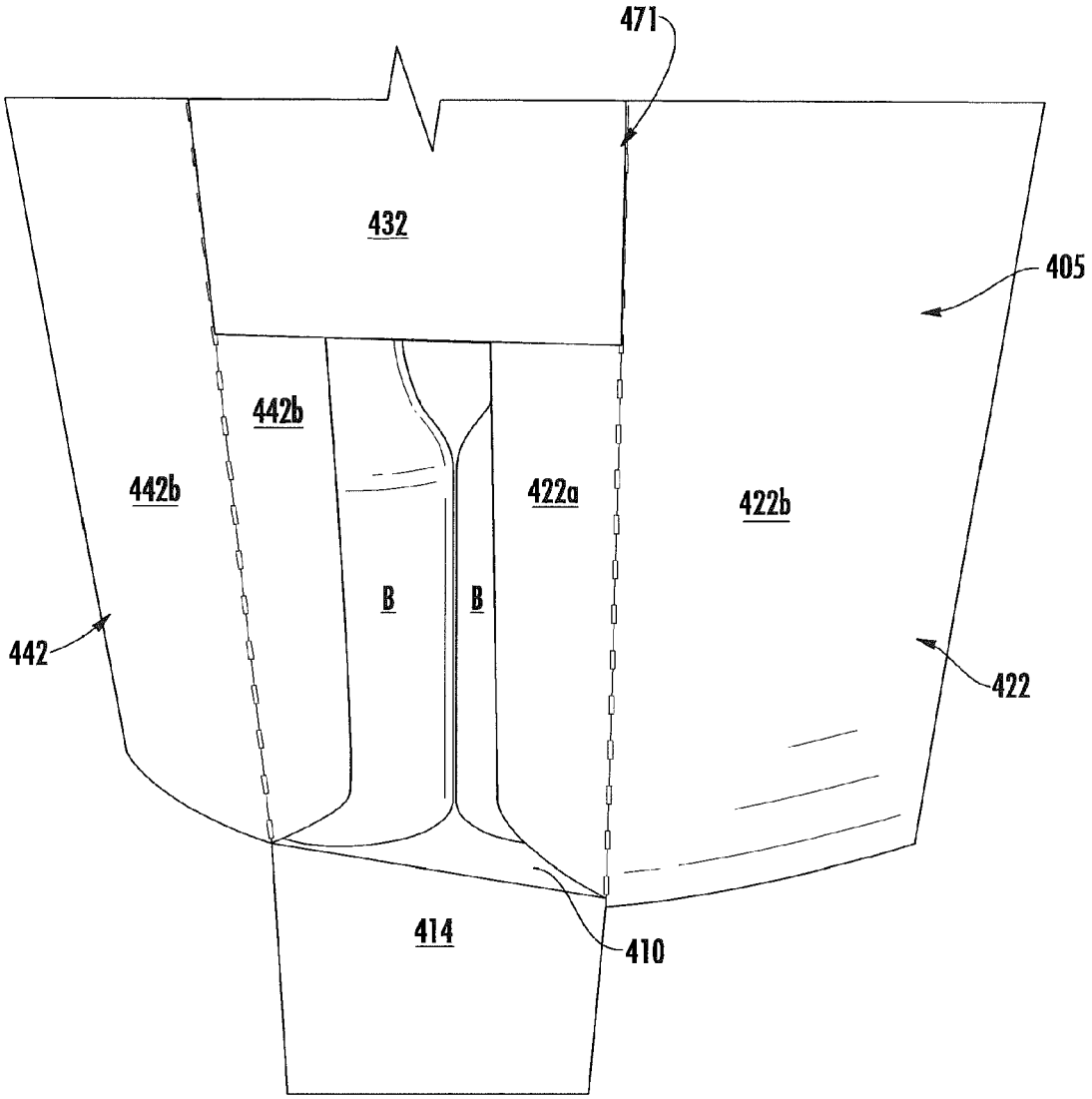
Figure 15:
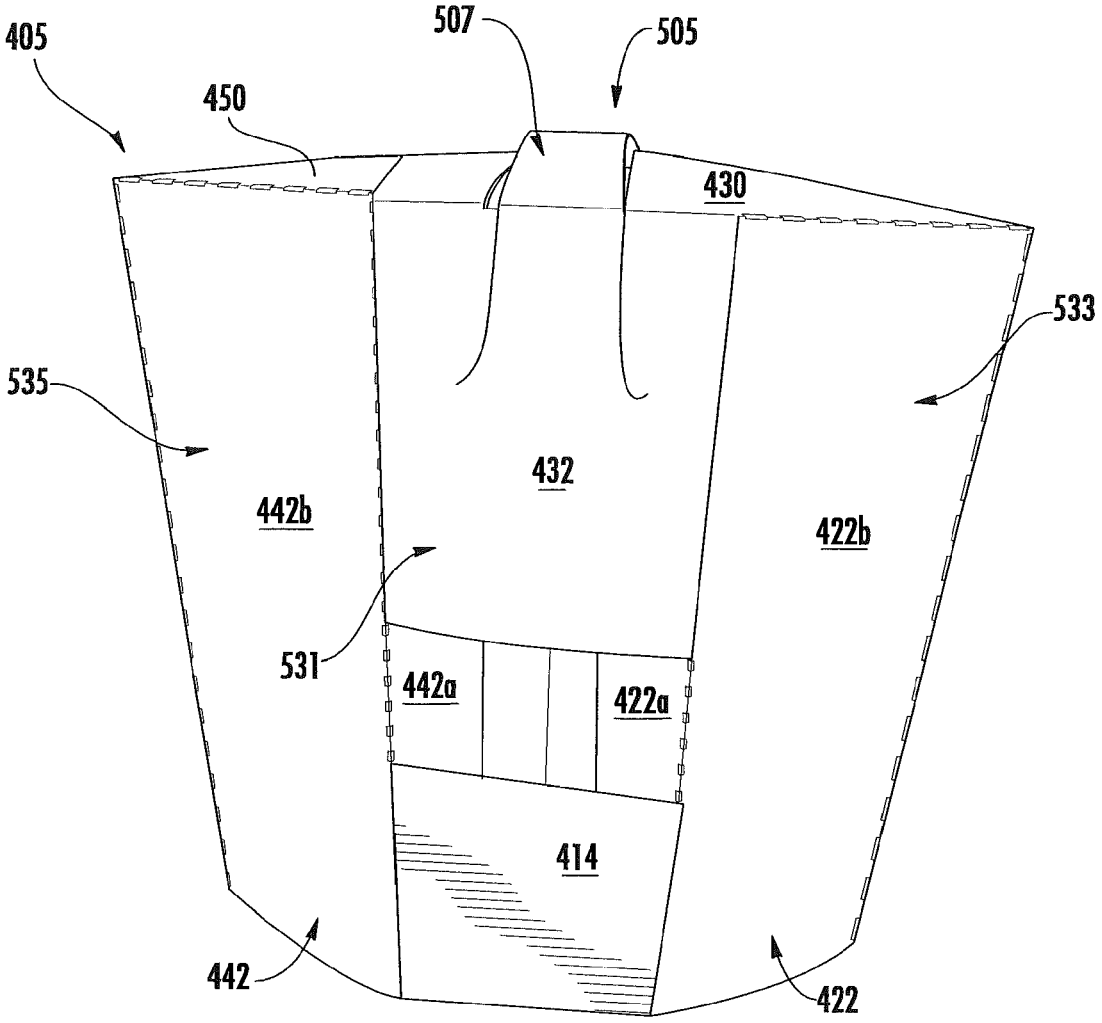
FIGS. 15 and 16 are perspective views of the erected carton according to the fourth embodiment of the disclosure.
Figure 16:
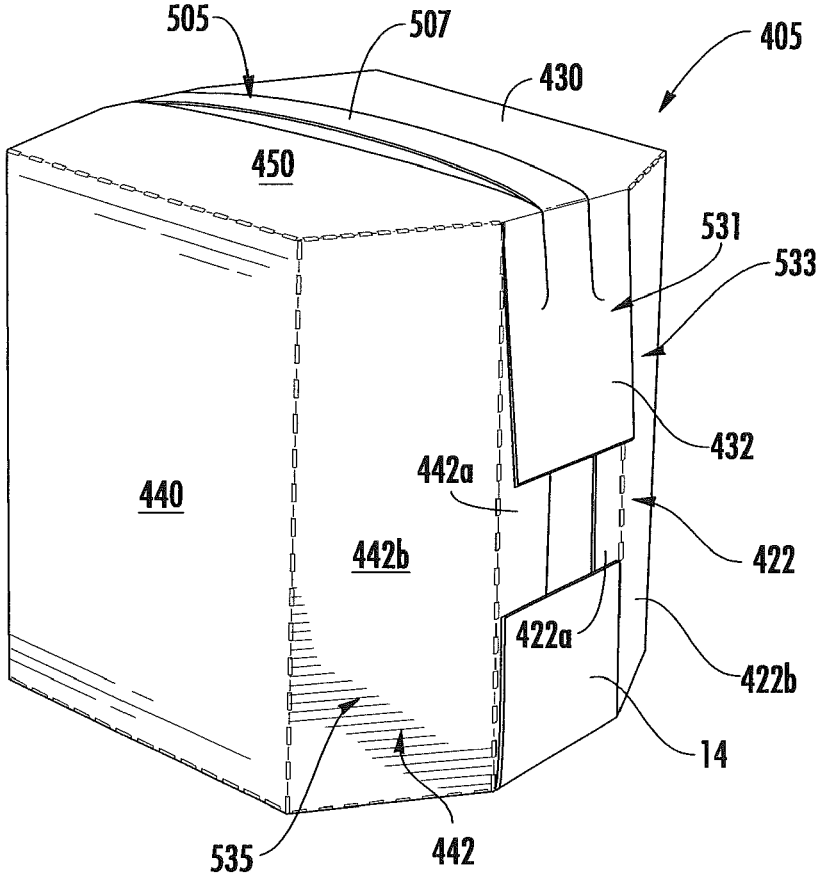

As shown in FIGS. 13 and 14, the carton 405 can be erected in a similar manner as the carton 5 in the first embodiment. The panels 420, 440, 430, 450 can be folded relative to the bottom panel 410 to form an open-ended sleeve 521 (FIG. 13). The handle reinforcement panels 509*a*, 509*b* and the respective reinforcing flaps 434, 454 can be folded along the lateral fold lines 435, 455 so that the handle reinforcement panels 509*a*, 509*b* are at least partially in face-to-face contact with the first handle panel 507 and the second handle panels 511, respectively, and the reinforcing end flaps 434, 454 are at least partially in face-to-face contact with the respective top end flaps 432, 452. When the first top panel 430 is positioned to at least partially overlap the second top panel 450, the first handle panel 507 and the first handle reinforcement panel 509*a* are positioned to at least partially overlap the second handle panels 511 and the second handle reinforcement panel 509*b*. Additionally, the top end flaps 432 and the reinforcing end flaps 434 can overlap the top end flaps 452 and the reinforcing end flaps 454. The top panels, the handle panels, the handle reinforcement panels, the top end flaps, and/or the reinforcing end flaps can be at least partially glued to form the handle 505 and the top of the carton (FIGS. 15 and 16). A user can grasp the handle 505, folding the handle flaps 515 downwardly or upwardly to carry the carton.

In the illustrated embodiment, the containers B can be loaded in nesting configuration N4 into the open-ended sleeve 521 before or after either of the ends 471, 473 is closed. The first end 471 can be closed by folding the oblique fold lines 75, 77 of the bottom end flaps 412, 416 upwardly and folding the side end flaps 422, 442 inwardly so that the base portions 422*b*, 442*b* of the side end flaps 422, 442 overlap the respective bottom end flaps 412, 416 and the base sections 412*c*, 416*c* of the bottom end flaps 412, 416 overlap the respective base sections 412*d*, 416*d*. As shown in FIGS. 14 and 15, the top end flaps 432, 452 and the reinforcing end flaps 434, 454 can be downwardly folded to overlap the outer portions 422*a*, 442*a* of the side end flaps 422, 442, and the bottom end flap 414 can be upwardly folded to overlap the outer portions 422*a*, 442*a* of the side end flaps 422, 442. Accordingly, as shown in FIG. 15, the bottom end flap 414, the top end flaps 432, 452, reinforcing end flaps 434, 454, and the outer portions 422*a*, 442*a* of the side end flaps form the central portion 531 of the first end 471, the bottom end flap 416 and the base portion 422*b* of the side end flap 422 form the first oblique portion 533 of the first end 471, and the bottom end flap 412 and the base portion 442*b* of the side end flap 442 form the second oblique portion 535 of the first end 471. The second end 473 can be formed in substantially the same manner as the first end 471. Alternatively, the ends 471, 473 could be different.

The blank 403 and carton 405 could be otherwise shaped, arranged, and/or configured without departing from the disclosure.

Figure 17:
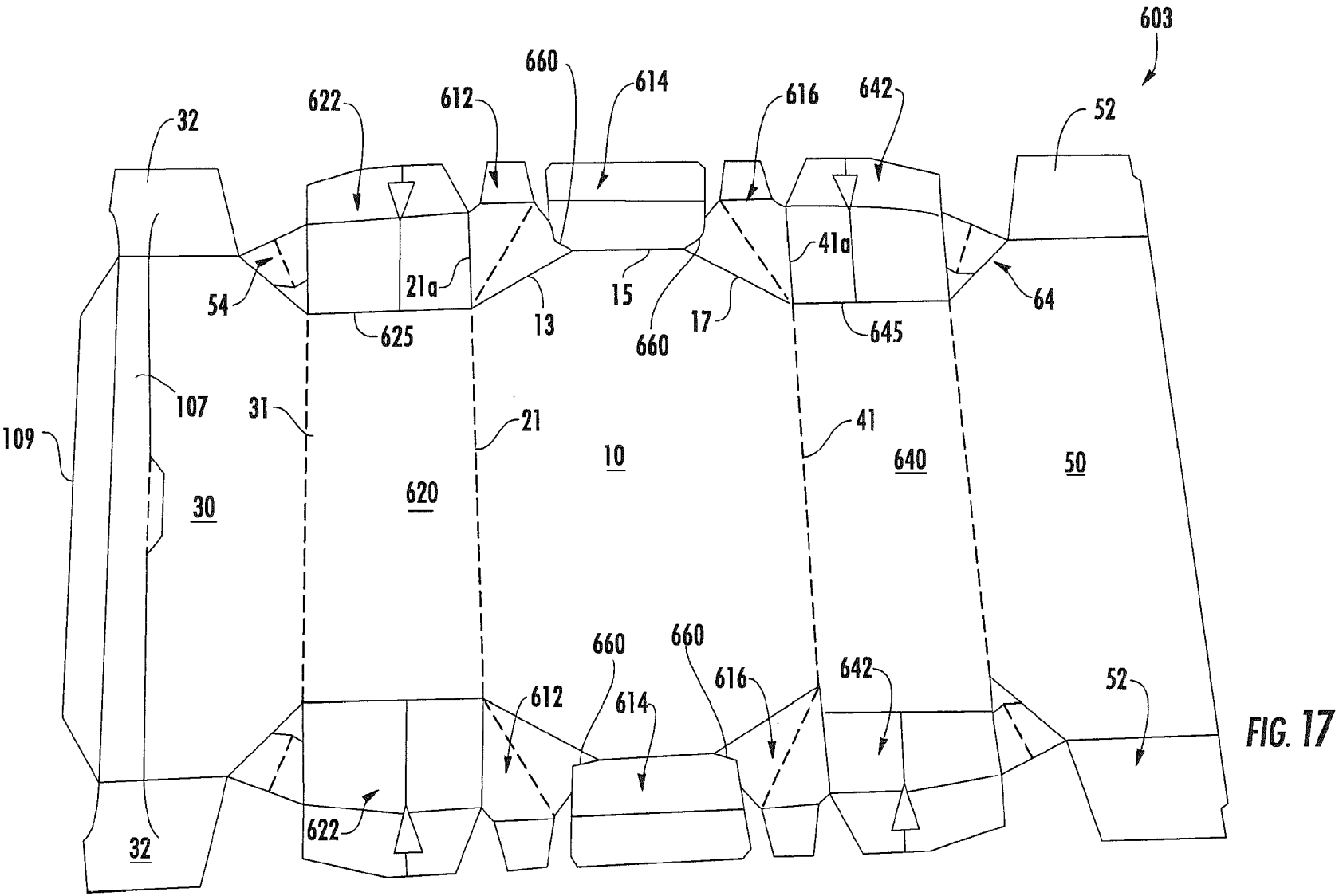
FIG. 17 is a plan view of a blank for forming a carton according to a fifth embodiment of the disclosure.
Figure 18:
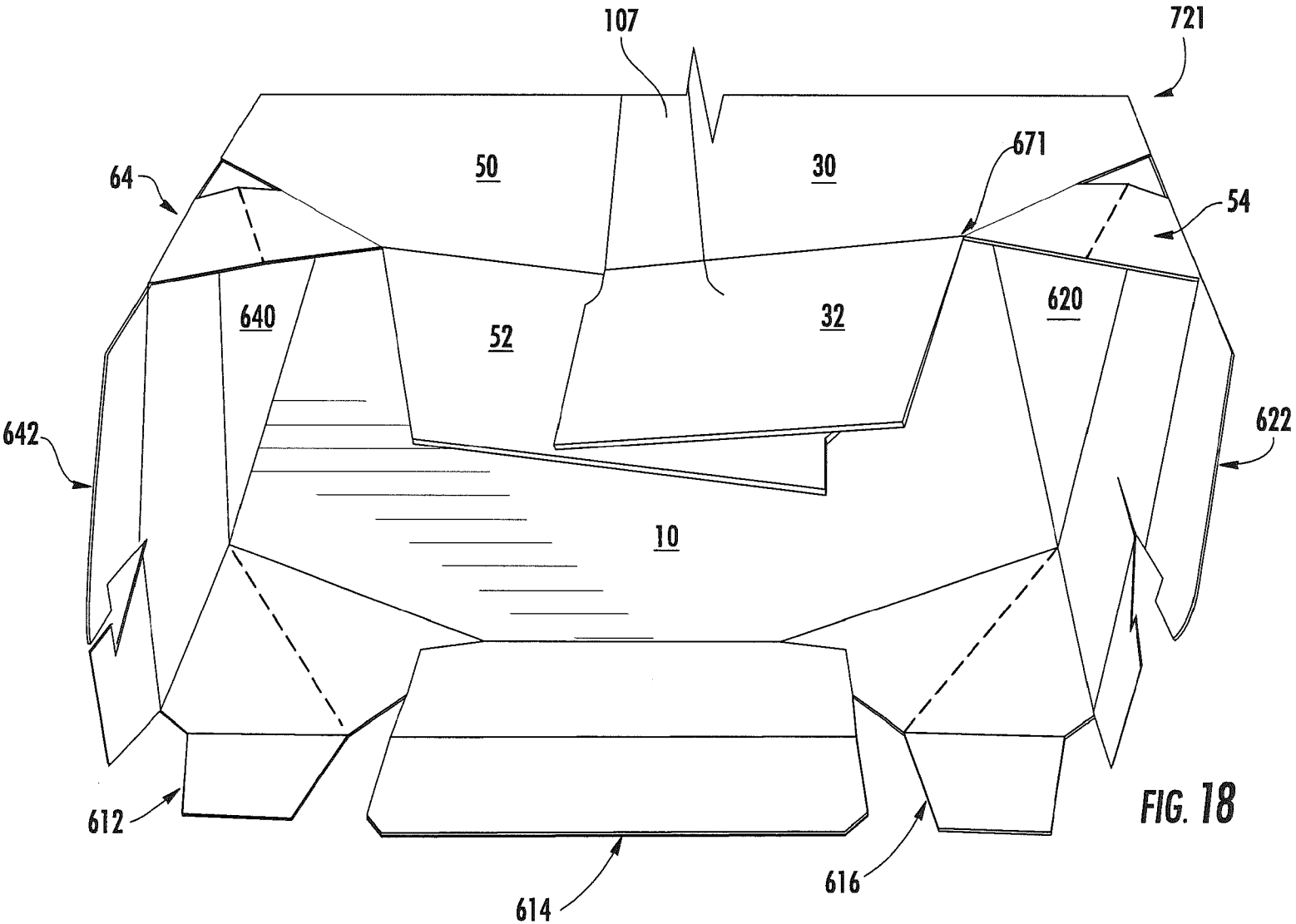
FIGS. 18-21 are perspective views showing the formation of the carton from the blank of FIG. 17 according to the fifth embodiment of the disclosure.
Figure 19:
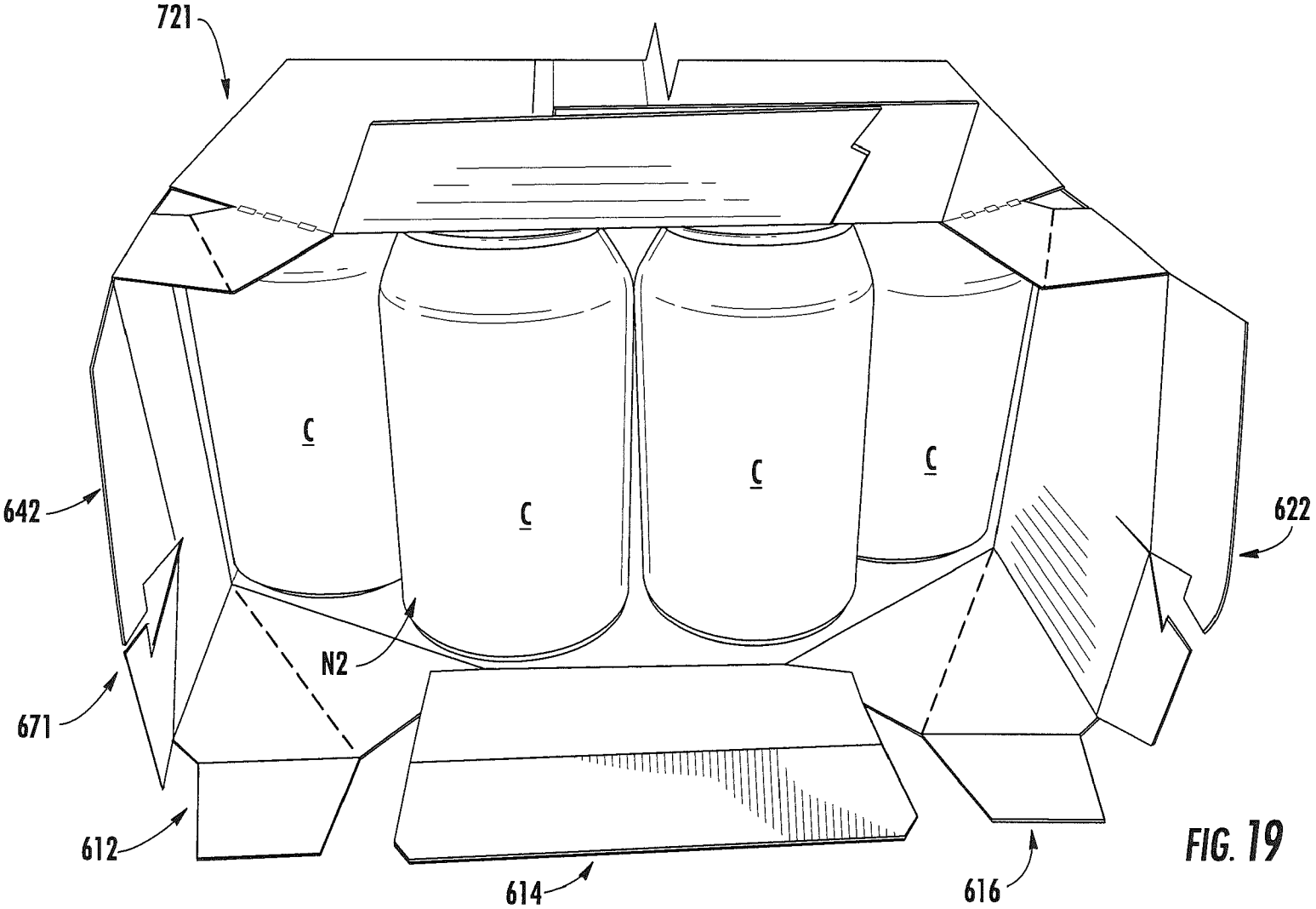
Figure 20:
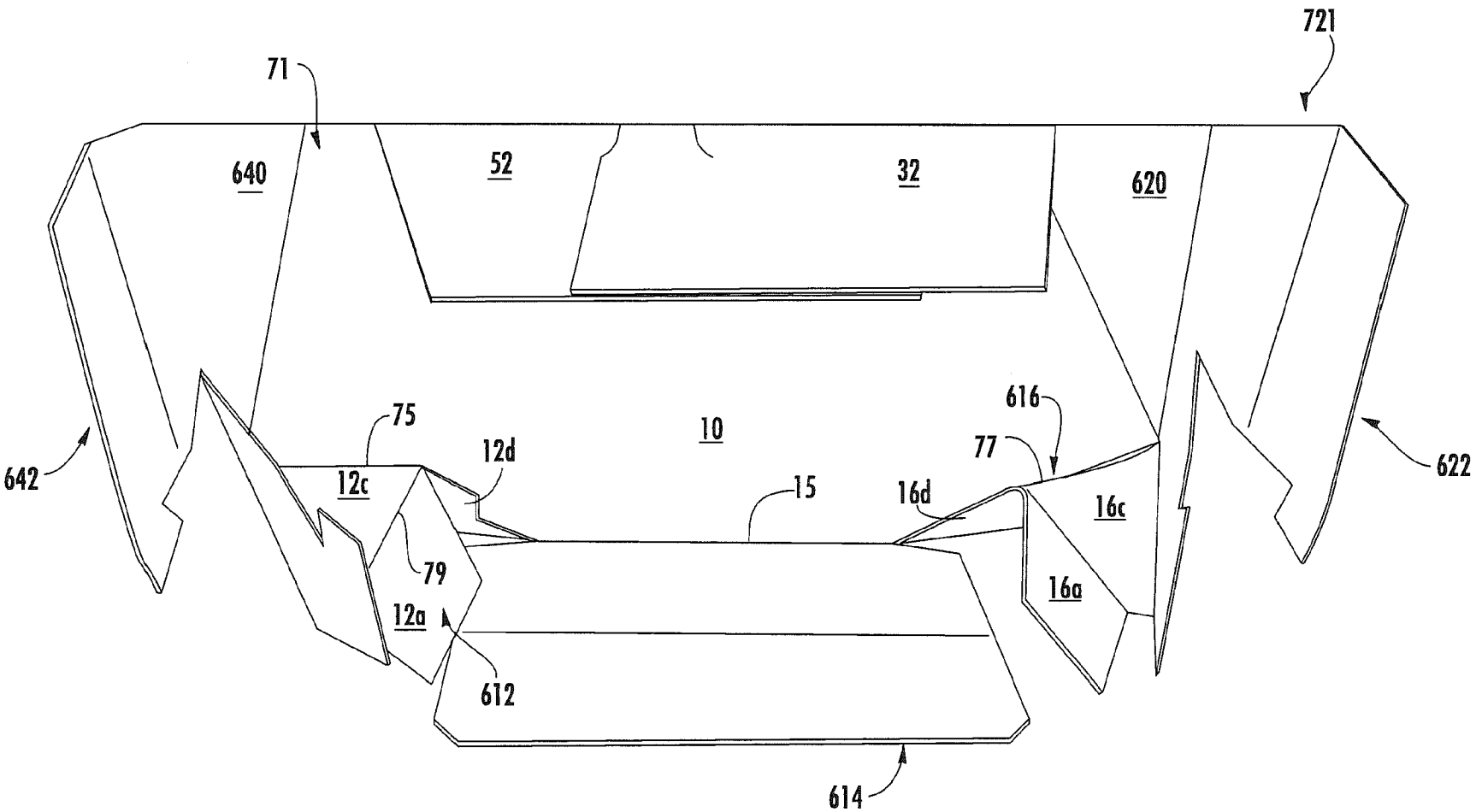
Figure 21:
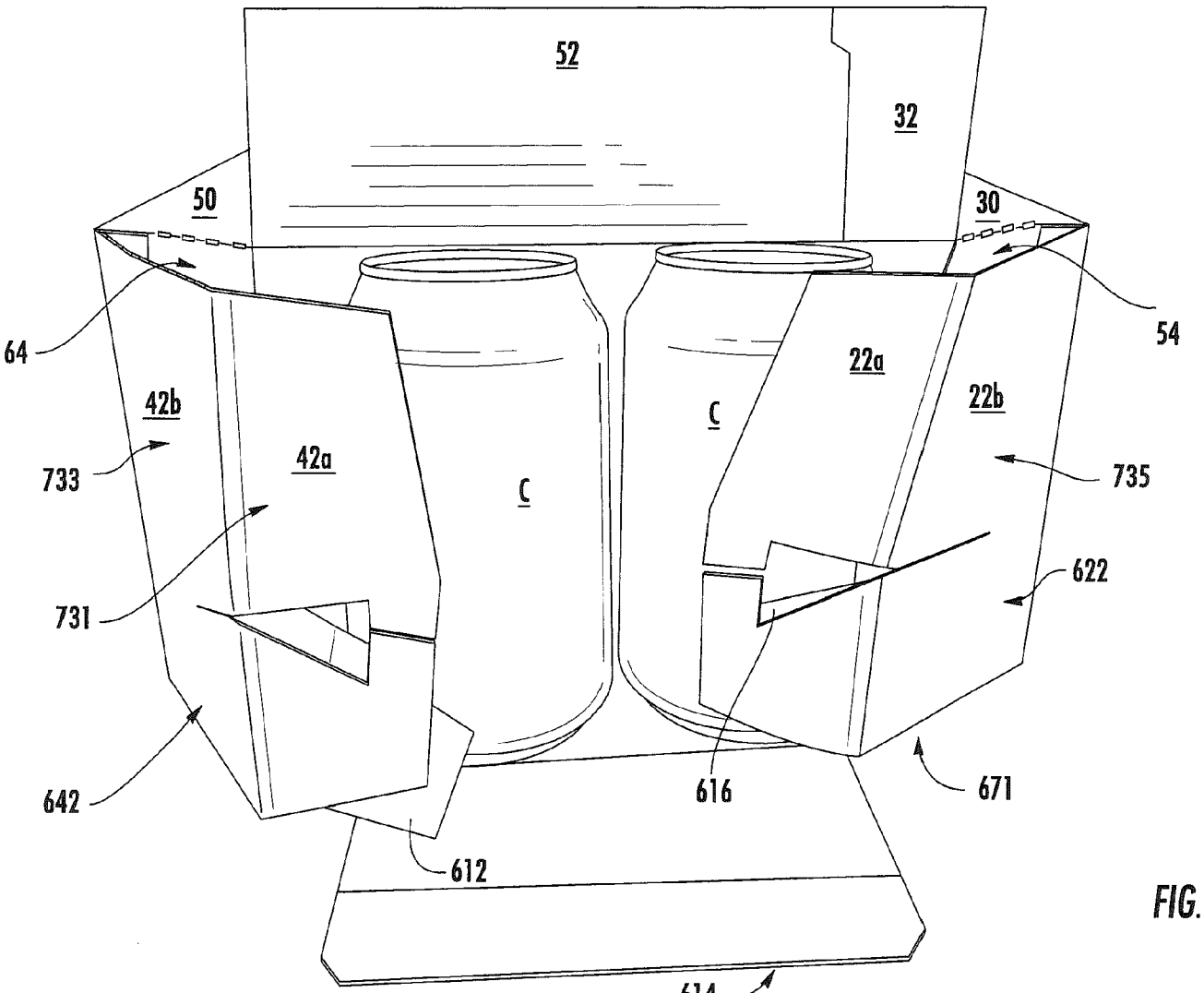
Figure 22:
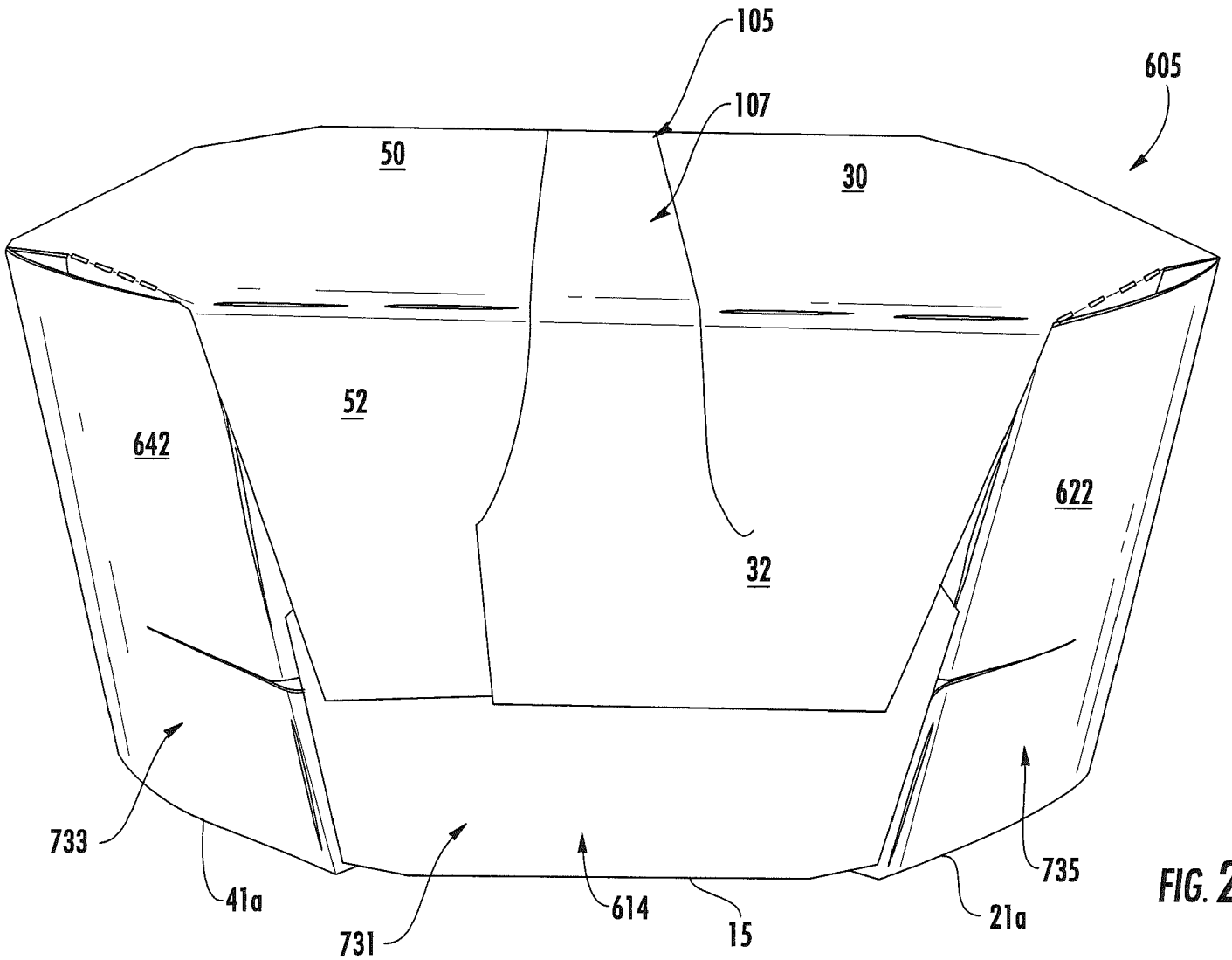
FIG. 22 is a perspective view of the erected carton according to the fifth embodiment of the disclosure.

FIGS. 17-22 illustrate a fifth embodiment of the disclosure that includes a carton 605 (FIG. 22) formed from a blank 603. The fifth embodiment is generally similar to the first embodiment, except for variations noted and variations that will be apparent to one of ordinary skill in the art. Accordingly, similar or identical features of the embodiments have been given like or similar reference numbers. In the fifth embodiment, the blank 603 and the carton 605 are configured to contain twenty-two containers in the form of 12-ounce beverage cans C arranged in a nested arrangement similar to the nested arrangement N2 shown for bottles B in FIG. 35. In the embodiment of FIG. 17, the blank 603 has bottom end flaps 612, 614, 616 and side end flaps 622, 642 that close in as similar manner as the first embodiment to form a central portion 731 and two oblique portions 733, 735 at each end 671, 673 of the carton 405 (FIG. 22).

As shown in FIG. 17, the bottom end flaps 612, 614, 616 in the fifth embodiment can have a slightly different shape than the end flaps 12, 14, 16 in the first embodiment, but are otherwise generally the same. The bottom end flaps 614 can be separable from the bottom end flaps 612, 616 along respective tear or cut lines 660. The side panels 620, 640 are similar to the side panels 20, 40 of the first embodiment, except that the respective lateral fold lines 85, 87 and the diamond corner panels 24, 44 are omitted. Accordingly the side end flaps 622, 642 are foldably connected to the respective side panels 620, 640 along longitudinal fold lines 625, 645. The side end flaps 622, 642 can otherwise be generally the same as the side end flaps 22, 42 of the first embodiment.

As shown in FIGS. 18-21, the blank 603 can be erected into an open-ended sleeve 721 (FIGS. 18-20), the containers C can be loaded in a nesting configuration N4, and the end 671 can be closed in a similar manner as in the first embodiment. Accordingly, as shown in FIG. 22, the closed end 671 of the carton 605 can have a central portion 731 that is generally perpendicular to the side panels 620, 640 and two oblique portions 733, 735 that are oblique with respect to the side panels 620, 640 and the central portion 731. The blank 603 and/or carton 605 could be otherwise shaped, arranged, and/or configured without departing from the disclosure.

Figure 23:
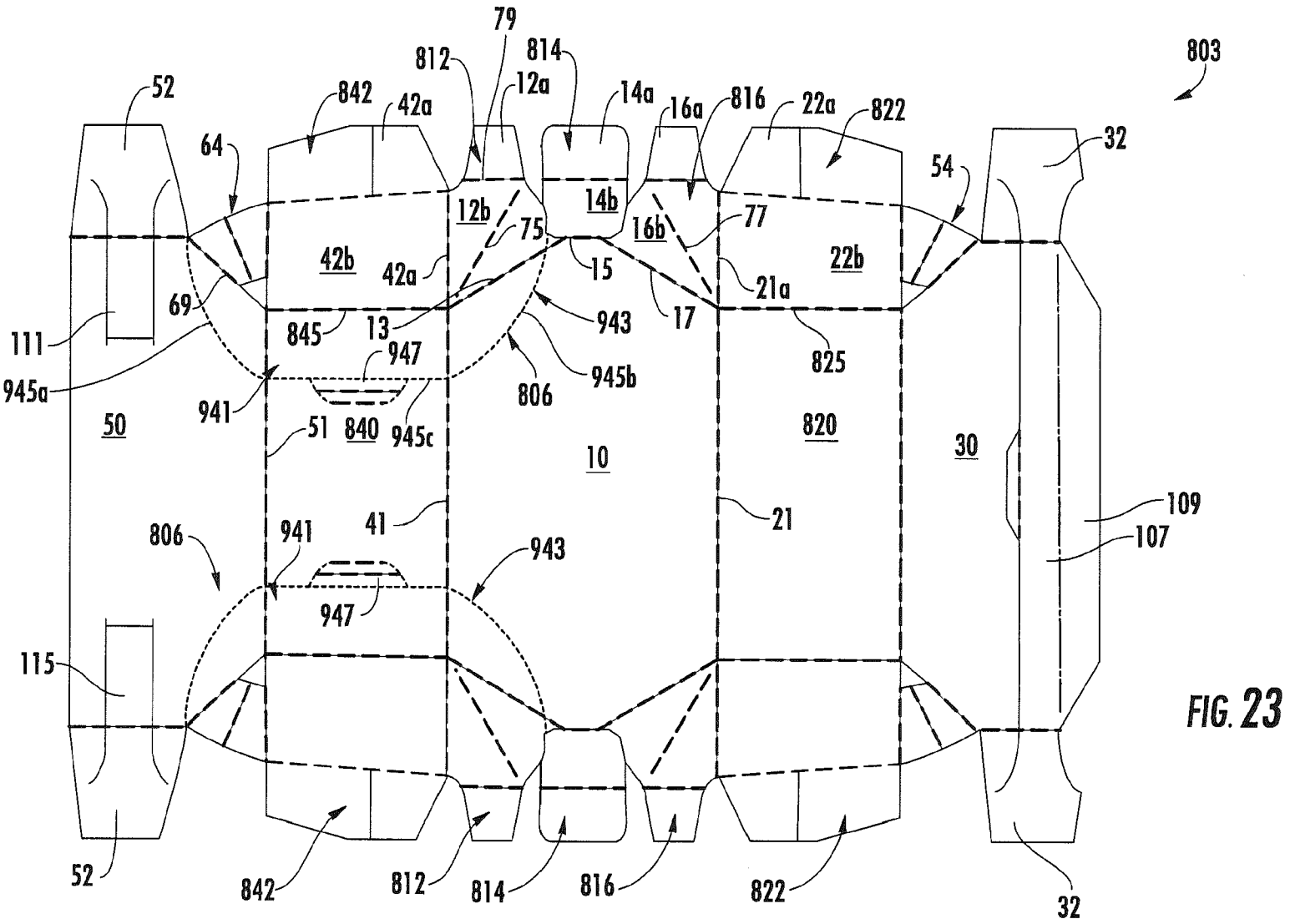
FIG. 23 is a plan view of a blank for forming a carton according to a sixth embodiment of the disclosure.

FIGS. 23-27 illustrate a sixth embodiment of the disclosure that includes a carton 805 formed from a blank 803. The sixth embodiment is generally similar to the first and the fifth embodiments, except for variations noted and variations that will be apparent to one of ordinary skill in the art. Accordingly, similar or identical features of the embodiments have been given like or similar reference numbers. In the sixth embodiment, the blank 803 and the carton 805 are configured to contain thirteen containers in the form of 12-ounce beverage cans C arranged in a nested arrangement with a middle row having five containers and two outer rows having four containers each (e.g., the containers C can be arranged in nested arrangement N13 shown in FIG. 35). In the embodiment of FIG. 23, the blank 803 has bottom end flaps 812, 814, 816 and side end flaps 822, 842 that are generally the same as the bottom end flaps 612, 614, 616 and side end flaps 622, 642 of the fifth embodiment. The general shapes of the flaps may be different in the illustrated embodiment.

Figure 27:
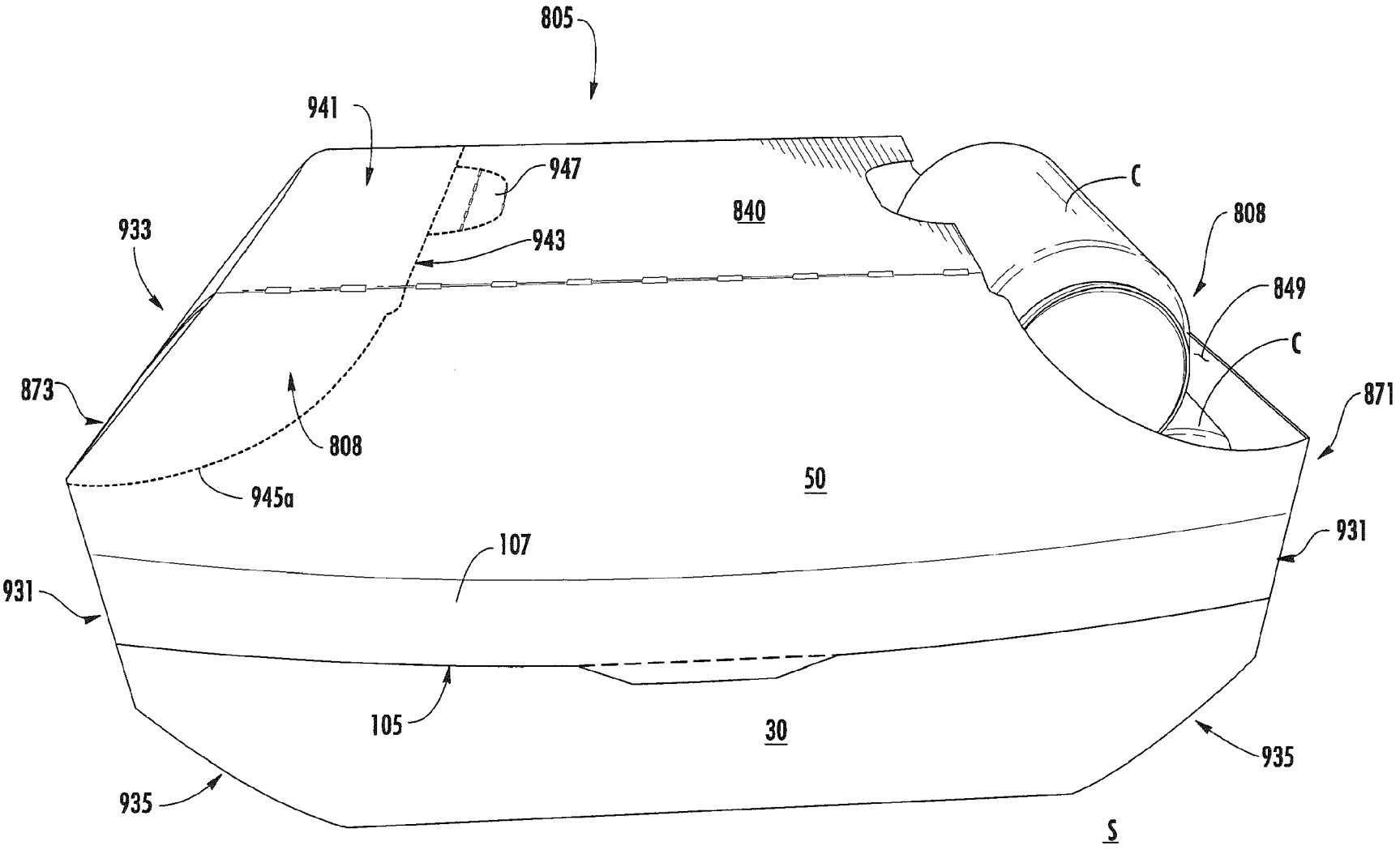
FIG. 27 is a perspective view of the carton of FIG. 26 with an actuated dispenser according to the sixth embodiment of the disclosure.

The blank 803 can include two dispenser patterns 806 for forming respective dispensers 808 at each end 871, 873 of the carton 805 (FIG. 27). Each of the dispenser patterns 806 and dispensers 808 can include a dispenser panel 941 defined by a tear line 943. In one embodiment, each dispenser panel 941 includes portions of the second side panel 840, the second top panel 50, the side end flap 842, the bottom end flap 812, and the bottom panel 10. Accordingly, each of the tear lines 943 includes a first curved portion 945*a* extending in the second top panel 50 from an end of the oblique fold line 69 to the second side panel 840, a second curved portion 945*b* extending from an edge of the bottom end flap 812 and in the bottom panel 10 to the second side panel 840, and a generally longitudinal portion 945*c* extending from an end of the first curved portion 945*a* to an end of the second curved portion 945*b*. An opening feature 947 can be formed in the second side panel 840 adjacent the longitudinal portion 945*c* of the tear line 943. The opening feature 947 can help initiate tearing of the tear line 943 to at least partially remove the dispenser panel 941. In one embodiment, the fold line 79 and/or the fold line 101 in the respective end flaps 812, 842 can be tear lines. The dispenser panels 941, tear lines 943, and/or dispensers 808 could be otherwise shaped, arranged, positioned, and/or configured without departing from the disclosure. Further one or both of the dispenser 808 and/or dispenser panels 941 could be omitted without departing from the disclosure.

Figure 24:
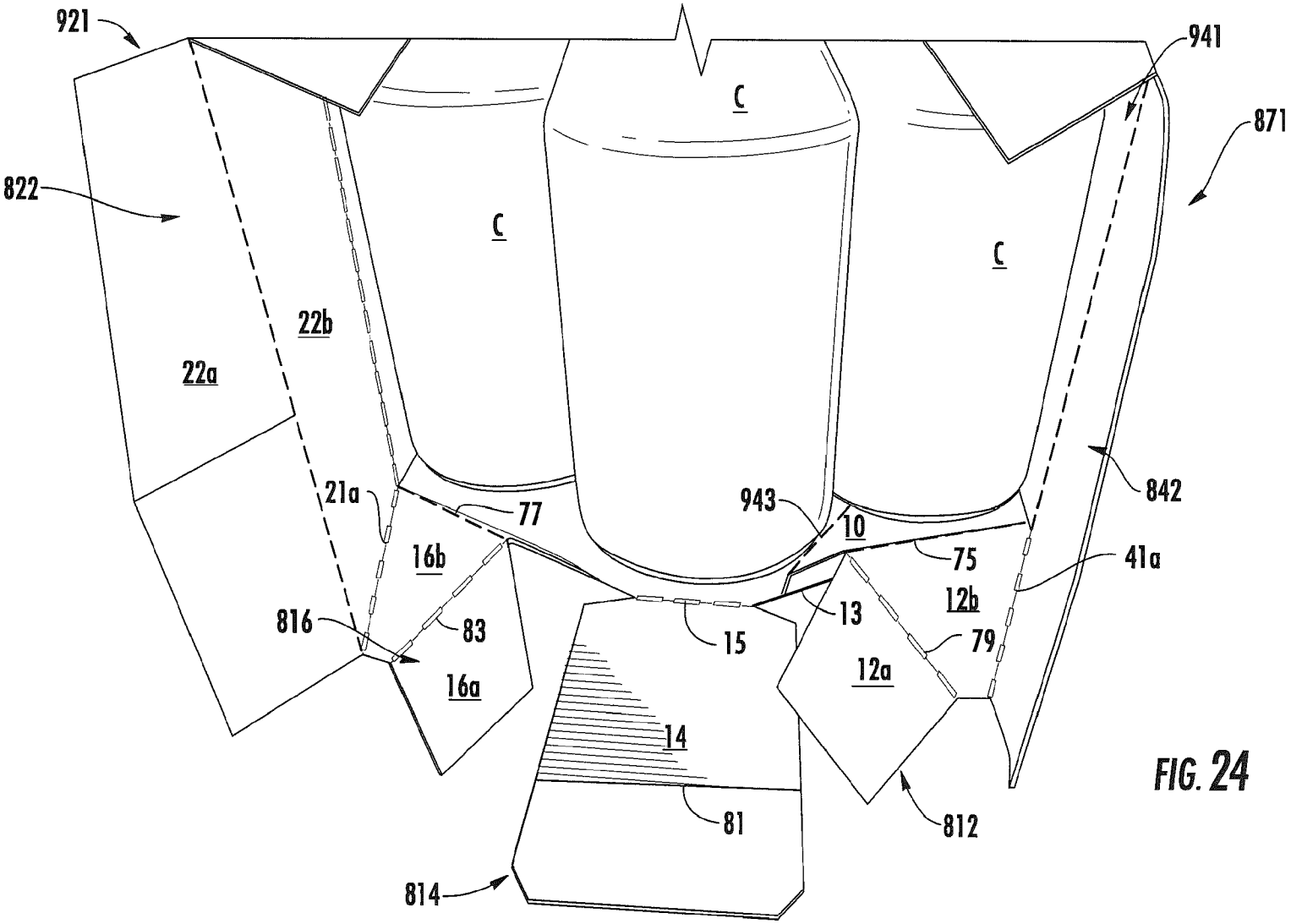
FIGS. 24 and 25 are perspective views showing the formation of the carton from the blank of FIG. 23 according to the sixth embodiment of the disclosure.
Figure 25:
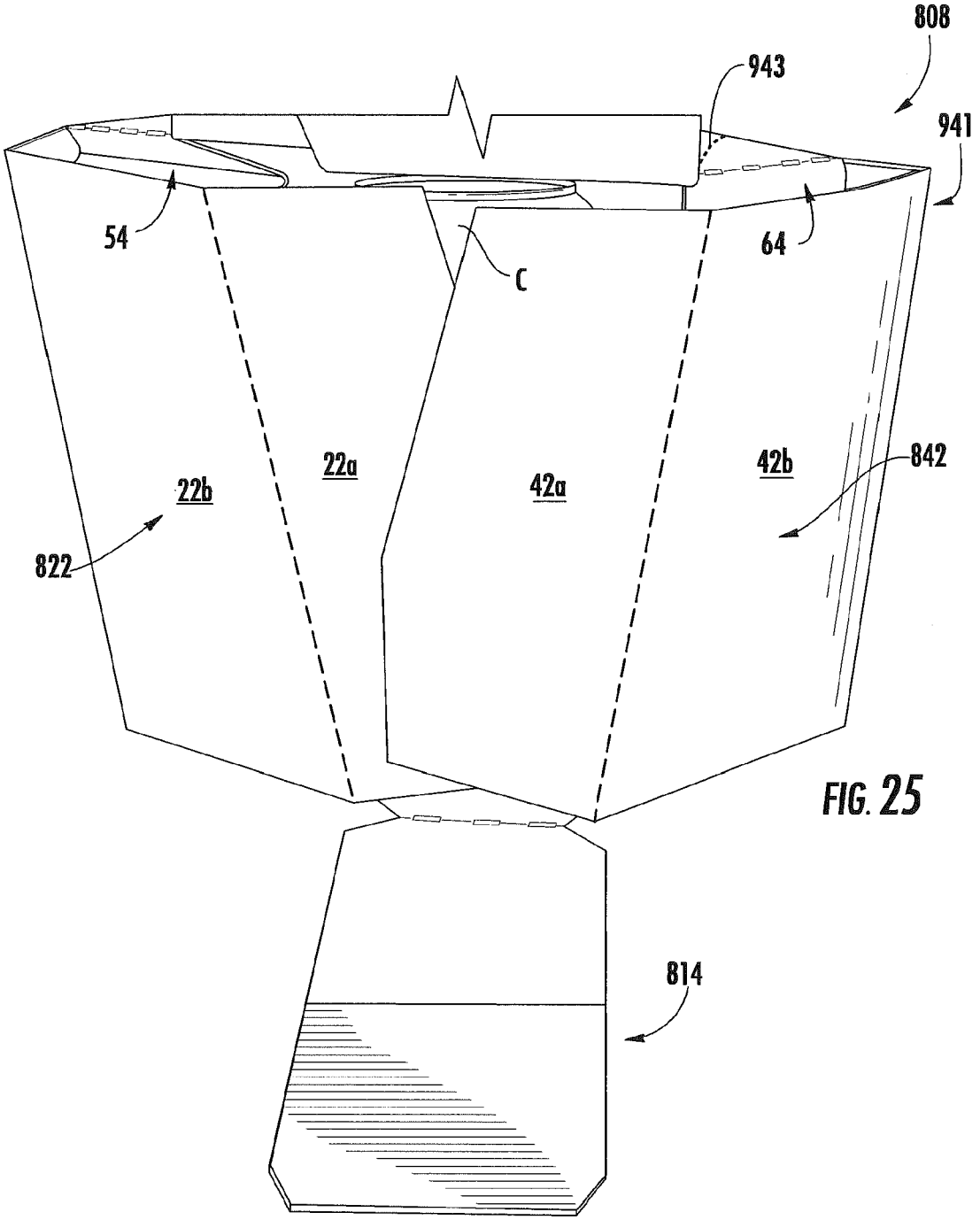
Figure 26:
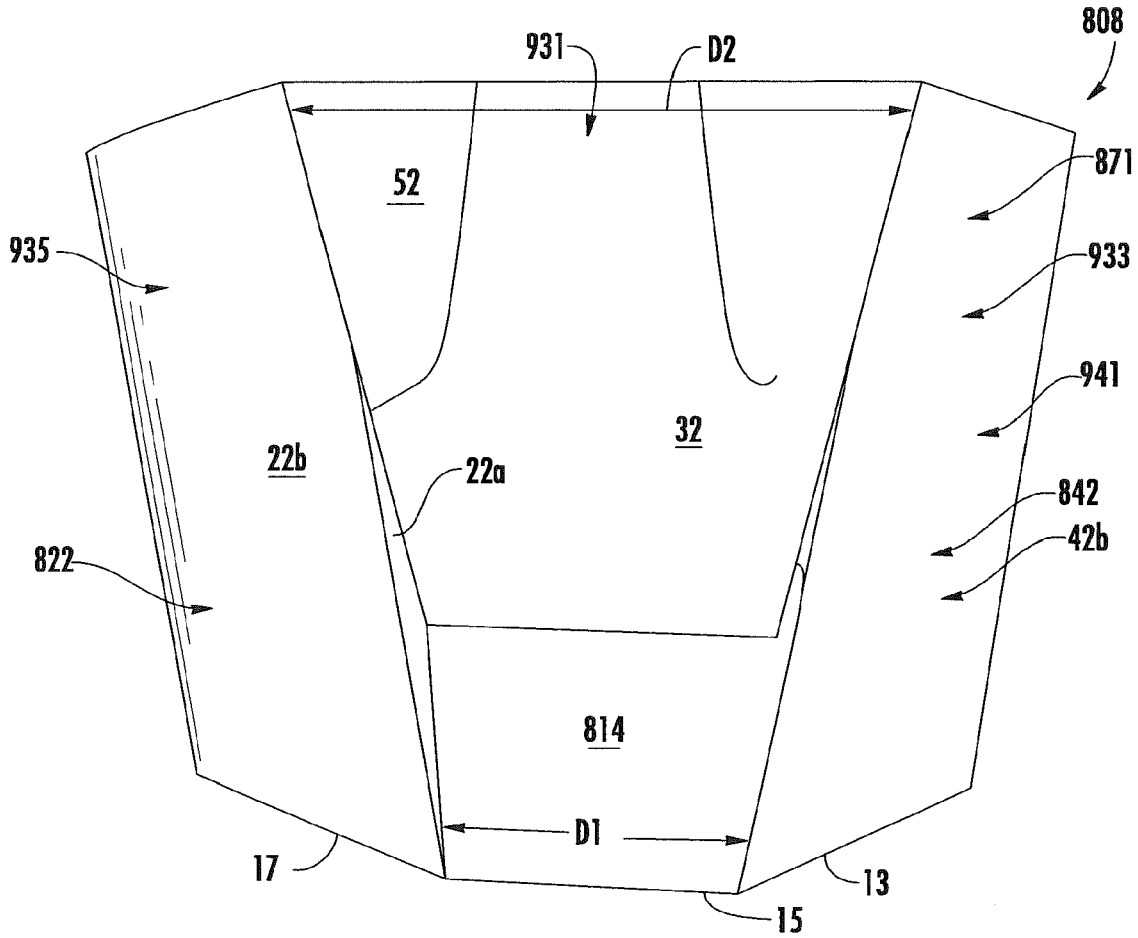
FIG. 26 is a perspective view of the erected carton according to the sixth embodiment of the disclosure.

As shown in FIGS. 24 and 25, the blank 803 can be erected into an open-ended sleeve 921 (FIG. 24), the containers C can be loaded into the sleeve (e.g., in nested arrangement N13), and the ends 871, 873 can be closed in a similar manner as in the first and fifth embodiments. Accordingly, as shown in FIGS. 26 and 27, the closed ends 871, 873 of the carton 805 can have a central portion 931 that is generally perpendicular to the side panels 820, 840 and two oblique portions 933, 935 that are oblique with respect to the side panels 820, 840 and the central portion 931. In one embodiment, the central portion 931 of the carton 805 has a width D1 near the bottom of the carton 805 that is less than the width D2 of the central portion near the top of the carton. As shown in FIG. 26, the distance D1 can be the width of the central bottom end flap 814 and the distance D2 can be the maximum width of the overlapped top end flaps 32, 52.

FIG. 27 shows the carton 805 with one of the dispenser panels 941 of the dispenser 808 removed to form a dispenser opening 949 at one end 871 of the carton. The carton 505 can be rotated 90 degrees from the carrying position (FIG. 26) to a dispensing position (FIG. 27). In the dispensing position, the carton 805 is positioned with the first side panel 820 positioned on a support surface S and the second side panel 840 positioned opposite the support surface. Removal of the dispenser panels 941 in the dispensing position of FIG. 27 creates the dispenser openings 949, allows access to the containers C, and helps prevent unintended removal of containers. The row of containers C adjacent the second side panel 840 has four containers and the middle row of containers with five containers is retained in the carton by the remaining portions of the end flaps 812, 814, 816, 822, 842, 852, 832 at the closed end 871, 873. The blank 803 and/or carton 805 could be otherwise shaped, arranged, positioned, and/or configured without departing from the disclosure.

FIGS. 28-33 illustrate a seventh embodiment of the disclosure that includes a carton 1005 formed from a blank 1003. The seventh embodiment is generally similar to the first and the sixth embodiments, except for variations noted and variations that will be apparent to one of ordinary skill in the art. Accordingly, similar or identical features of the embodiments have been given like or similar reference numbers. In the seventh embodiment, the blank 1003 and the carton 1005 are configured to contain nine containers in the form of 12-ounce beverage cans C arranged in two layers: a bottom layer having five containers and a top layer having four containers. The two layers of containers are arranged so that the ends 1071, 1073 of the carton 1005 are angled inwardly from the bottom of the carton 1005 to the top of the carton. The containers C could be otherwise shaped, arranged, positioned, and/or configured without departing from the disclosure.

In the embodiment of FIGS. 28-33, the blank 1003 comprises a bottom panel 1010, a first side panel 1020 foldably connected to the bottom panel 1010 along a lateral fold line 1021, a top panel 1030 foldably connected to the first side panel 1020 along a lateral fold line 1031, and a second side panel 1040 foldably connected to the bottom panel 1010 along a lateral fold line 1041. An adhesive or attachment flap 1050 is foldably connected to the second side panel 1040 along a lateral fold line 1051 for adhesive attachment to the top panel 1030. In one embodiment, the blank 1003 has an upper side end flap 1022 foldably connected to the first side panel 1020 at an oblique fold line 1023 and a lower side end flap 1024 foldably connected to the first side panel 1020 at a longitudinal fold line 1025. Similarly, the blank 1003 has an upper side end flap 1042 foldably connected to the second side panel 1040 at an oblique fold line 1043 and a lower side end flap 1044 foldably connected to the second side panel 1040 at a longitudinal fold line 1045. The blank 1003 includes a top end flap 1032 foldably connected to the top panel 1030 at a longitudinal fold line 1033 and a bottom end flap 1014 foldably connected to the bottom panel 1010 at a longitudinal fold line 1015. The end flaps 1014, 1022, 1024, 1032, 1042, 1044 can be overlapped with respect to one another to at least partially close the first end 1071 of the carton. Additionally, the second end of the blank 1003 includes respective end flaps 1014, 1022, 1024, 1032, 1042, 1044 that close the second end 1073 of the carton 1005 that are identical to the end flaps for closing the first end 1071 of the carton. Alternatively, the ends 1071, 1073 could be different from one another The blank 1003 could be otherwise shaped, arranged, positioned, and/or configured without departing from the disclosure.

Figure 28:
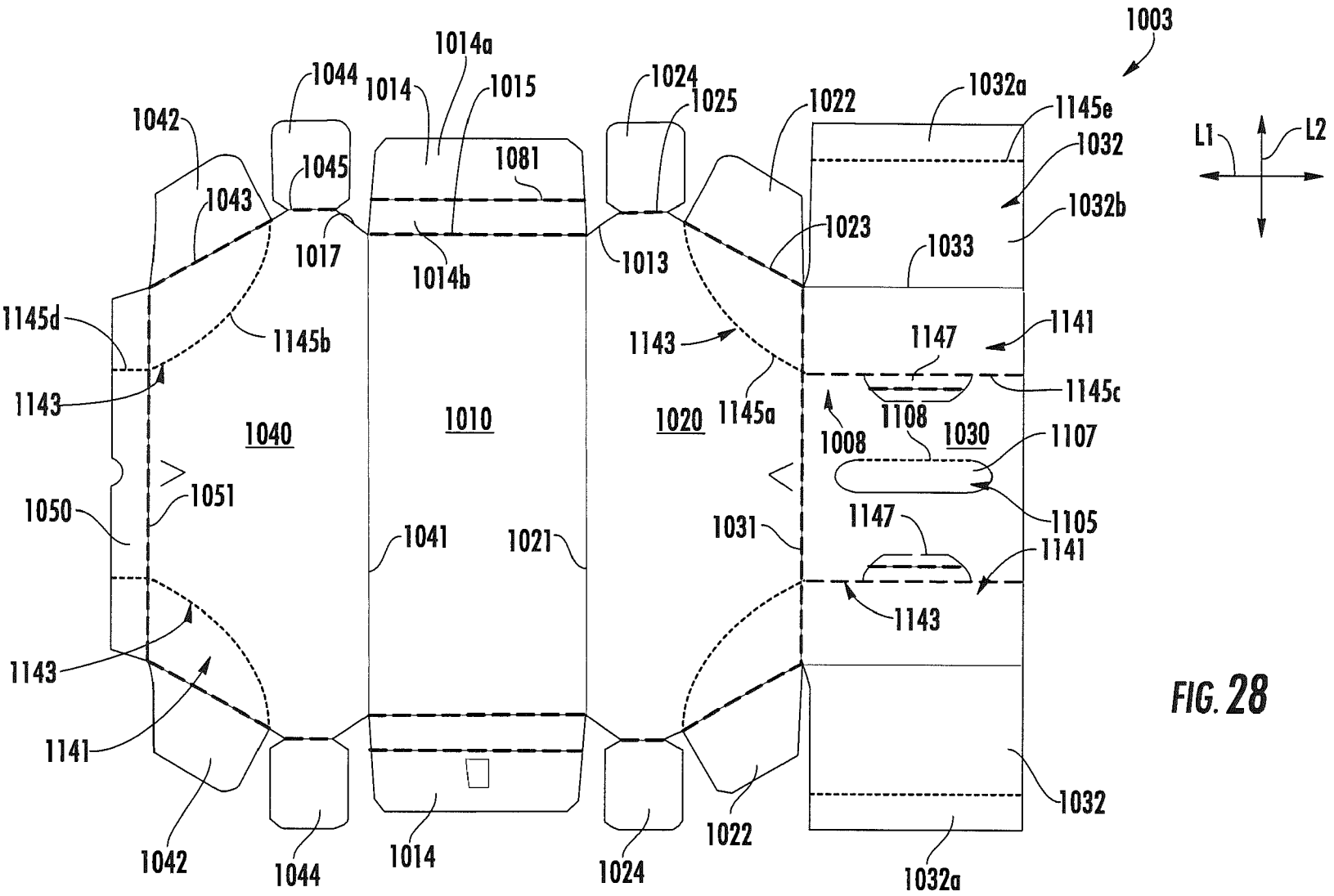
FIG. 28 is a plan view of a blank for forming a carton according to a seventh embodiment of the disclosure.

As shown in FIG. 28, each of the side panels 1020, 1040 includes a respective oblique edge 1013, 1017 extending from respective ends of the longitudinal fold line 1015 to the respective longitudinal fold line 1025, 1045. The bottom end flap 1014 includes an outer portion 1014*a* foldably connected to a base portion 1014*b* along a longitudinal fold line 1081. In the illustrated embodiment, the base portion 1014*b* is for being positioned to extend obliquely from the bottom panel 1010 along the oblique edges 1013, 1017 when the carton 1005 is erected.

Figure 29:
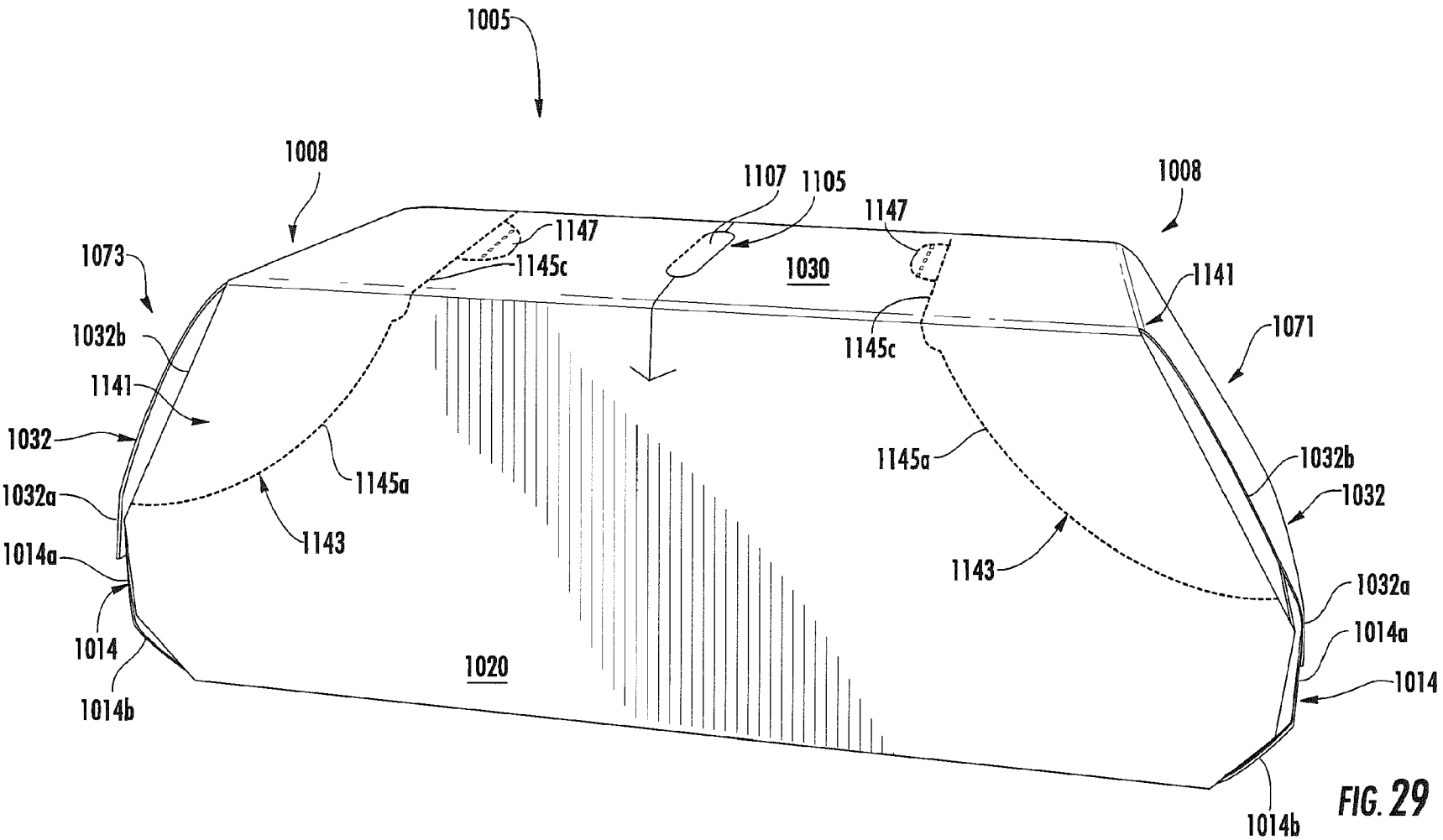
FIGS. 29 and 30 are perspective views of the erected carton according to the seventh embodiment of the disclosure.
Figure 30:
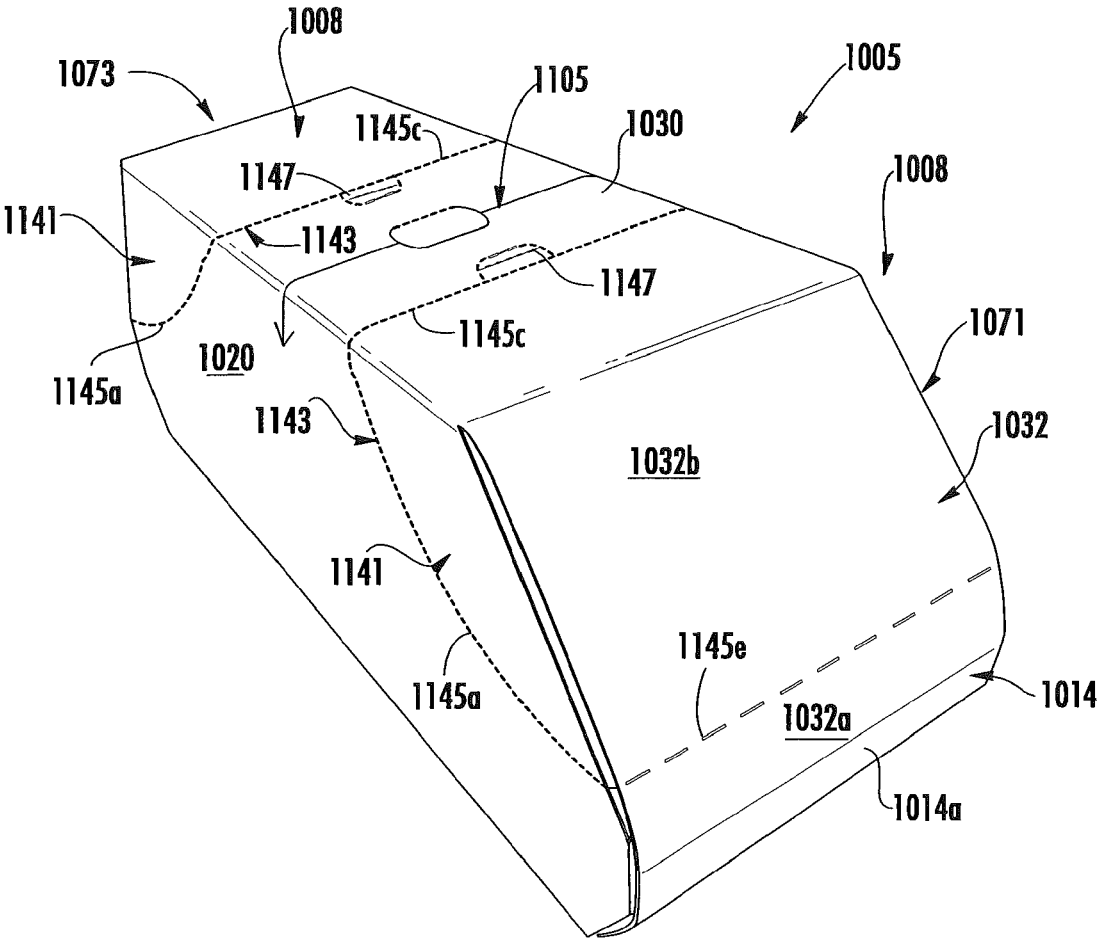

In the embodiment of FIGS. 28-33, the carton 605 includes two dispenser patterns 1006, each including a dispenser panel 1141 defined by a respective tear line 1143 in the blank 1003 for forming a dispenser 1008 at each end 1071, 1073 of the carton 1005 (FIGS. 29 and 30). In one embodiment, each dispenser panel 1141 includes portions of the first side panel 1020, the top panel 1030, the second side panel 1040, the attachment flap 1050, the top end flap 1032, and the upper side end flaps 1022,1042. As shown in FIG. 28, the tear line 1143 can include a first curved portion 1145*a* extending in the first side panel 1020 from an end of the oblique fold line 1023 to the top panel 1030, a second curved portion 1145*b* extending in the second side panel 1040 to the attachment flap 1050, a first longitudinal portion 1145*c* extending from the end of the first curved portion 1145*a* to an edge of the top panel 1030, and a second longitudinal portion 1145*d* extending from the end of the second curved portion 1145*b* to an edge of the attachment flap 1050. When the carton 1005 is erected, the first longitudinal portion 1145*c* can at least partially overlap the second longitudinal portion 1145*d*. In one embodiment, each of the top end flaps 1032 can include an outer portion 1032*a* that is separable from a base portion 1032*b* along a third longitudinal portion 1045*e* of the tear line 1143. An access feature 1147 can be formed in the top panel 1030 adjacent the first longitudinal portion 1145*c* of the tear line 1143 to help initiate tearing of the tear line 1143 when actuating the dispenser 1008. The dispenser panels 1141, tear lines 1143, or dispensers 1008 could be otherwise shaped, arranged, and/or configured without departing from the disclosure. Further, one or both of the dispensers 1008 and/or dispenser panels 1141 could be omitted without departing from the disclosure.

In one embodiment, the carton 1005 includes a handle 1105 formed in the top panel 1030 for grasping and carrying the carton 1005. The handle 1105 can include a handle panel 1107 foldably connected to the top panel 1030 along a longitudinal fold line 1108. The handle 1105 could be omitted or could be otherwise shaped, arranged, positioned, and/or configured without departing from the disclosure.

Figure 31:
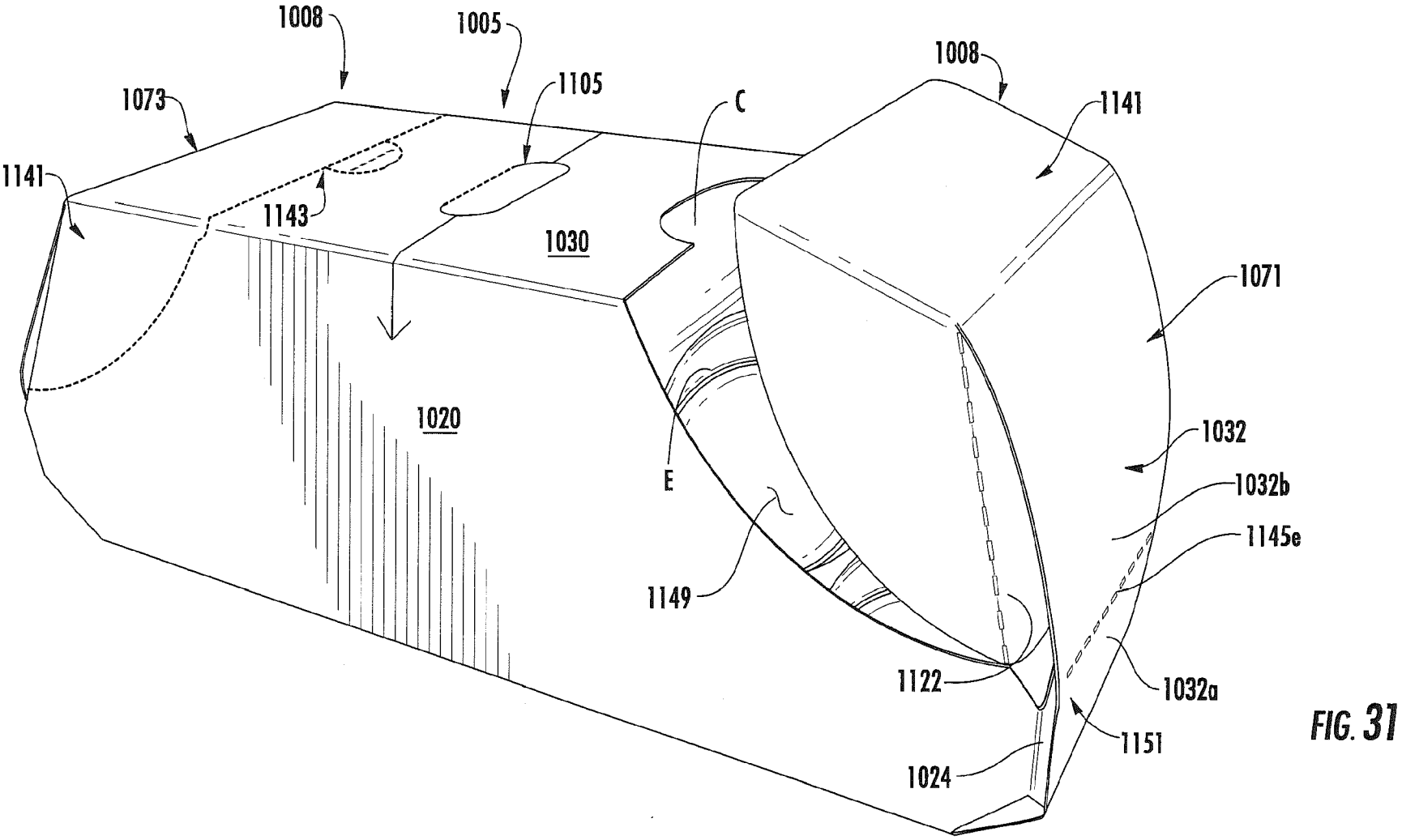
FIGS. 31 and 32 are perspective views of the carton showing the removal of the dispenser panel according the seventh embodiment of the disclosure.
Figure 32:
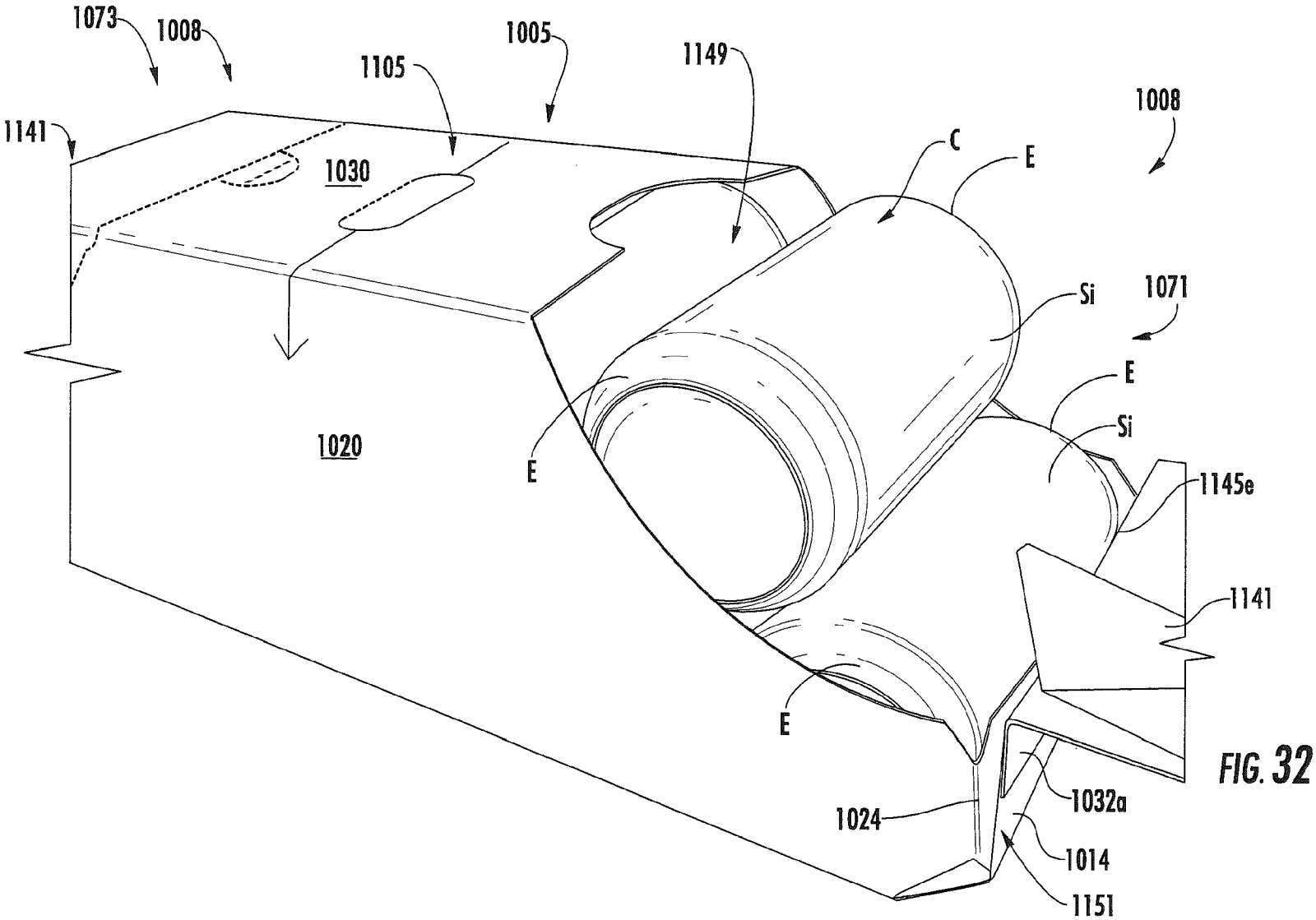
Figure 33:
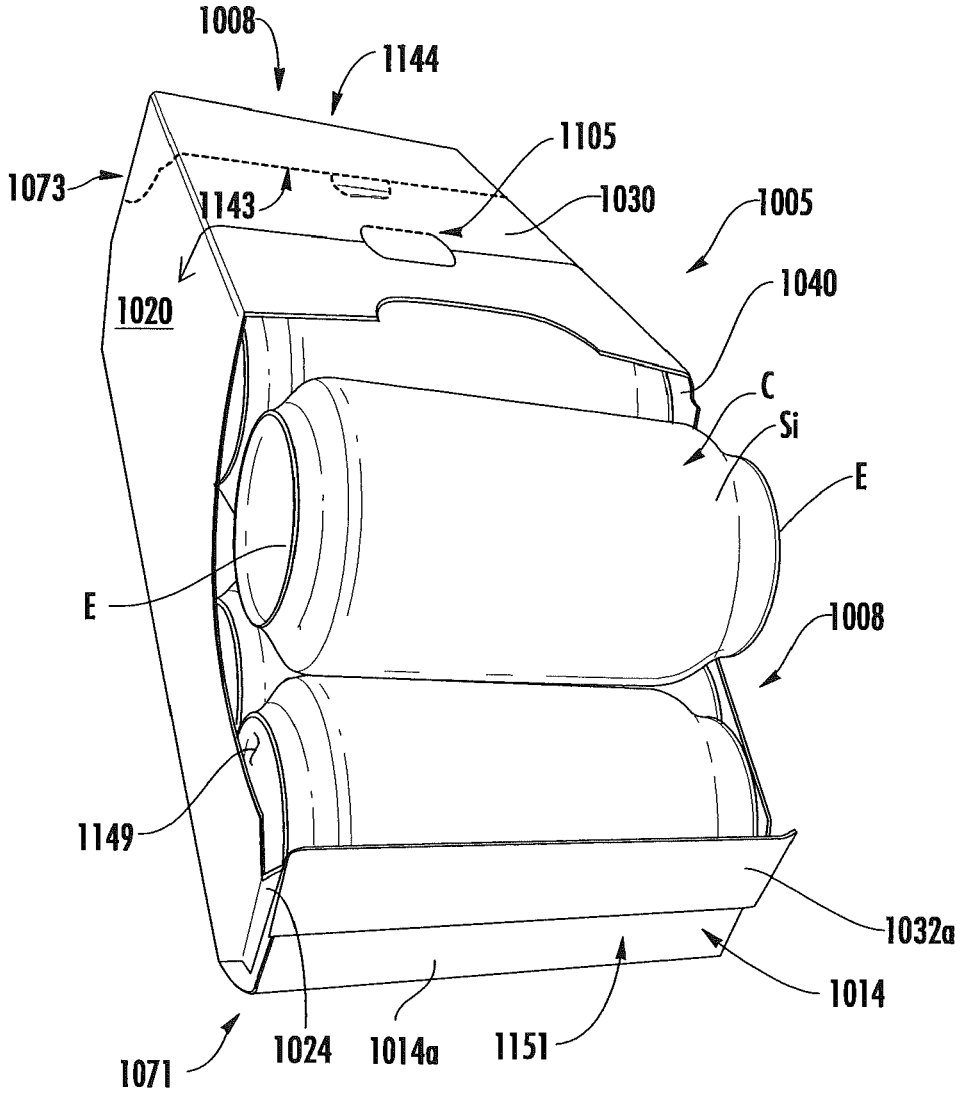
FIG. 33 is a perspective view of the carton with the dispenser panel removed according to the seventh embodiment of the disclosure.

In one embodiment, the beverage cans C have respective ends E and cylindrical sides Si extending between the ends (e.g., FIGS. 31-33). In the seventh embodiment, the containers C are positioned and arranged so that the sides Si of the containers in the top row or layer are positioned adjacent or in contact with the top panel 1030, and the sides of the bottom row of containers are positioned adjacent or in contact with the bottom panel 1010. The ends E of the containers are adjacent or in contact with one of the first side panel 1020 and the second side panel 1040.

The carton 1005 is formed in a similar manner as the cartons in the previous embodiments. For example, an open-ended sleeve (not shown) can be formed by folding the panels 1010, 1020, 1030, 1040, 1050 around an interior of the sleeve and adhering the attachment flap 1050 to an interior surface of the top panel 1030. The ends 1071, 1073 of the carton 1005 can be closed by folding the upper side end flaps 1022, 1042 and the lower side end flaps 1024, 1044 over the respective ends, upwardly folding the bottom end flaps 1014, and downwardly folding the top end flaps 1032 to overlap the respective side end flaps 1022, 1042, 1024, 1044 at the respective ends. In one embodiment, the bottom end flap 1014 can be folded over the end of the carton so that the base portion 1014*b* is oblique with respect to the bottom panel 1010 and aligned with the oblique edges 1013, 1017. The outer portion 1014*a* of the bottom end flap 1014 can overlap the lower side end flaps 1024, 1044, and the portion 1014*a* and the flaps 1024, 1044 can be generally perpendicular to the side panels 1020, 1040, the bottom panel 1010 and the top panel 1030. The base portion 1032*b* of the top end flap 1032 can overlap the upper side end flaps 1022, 1042 and the base portion 1032*b* and the upper side end flaps 1022, 1042 can extend obliquely with respect to the top panel 1030 and can be generally aligned with the oblique fold lines 1023, 1043. The outer portion 1032*a* of the top end flap 1032 can overlap the outer portion 1014*a* of the bottom end flap 1014 and/or the lower side end flaps 1022, 1042. One or more of the end flaps 1014, 1022, 1024, 1032, 1042, 1044 can be secured together with adhesive such as glue. The erected carton 1005 is shown in FIGS. 29 and 30.

Either or both of the dispensers 1008 can be activated as shown in FIGS. 31-33 to at least partially remove the respective dispenser panel 1141 from the carton 1005 and create a respective dispenser opening 1149 for accessing the containers C at a respective end 1071, 1073 of the carton. The dispenser 1008 at the first end 1071, for example, can be actuated by initiating tearing of the tear line 1143 at the access feature 1147, tearing the tear line along the longitudinal portions 1145*c*, 1145*d*, and tearing the tear line 1143 along the curved portions 1145*a*, 1145*b* in the side panels 1020, 1040 as the dispenser panel 1141 is pivoted away from the remainder of the carton 1005 along the longitudinal portion 1145*e* of the tear line 1143 in the top end flap 1032. As shown in FIG. 31-33, when the dispenser panel 1141 is partially or completely removed to create the dispenser opening 1149, the carton 1005 includes a retention portion 1151 at the bottom of the respective end 1071, 1073 of the carton to retain the lower layer of containers C at the end of the carton. In one embodiment, the retention portion 1151 includes the lower side end flaps 1024, 1044, the bottom end flap 1014, and the distal or outer portion 1032*a* of the top end flap 1032. As shown in FIGS. 32 and 33, the dispenser panel 1141 can be completely removed from the remainder of the carton 1005 by further tearing the tear line 1143 along the longitudinal portion 1145*e*. The retention portion 1151 extends across the width of the ends 1071, 1073 of the carton and has a height to retain the end container of at least the lower layer of containers C when the dispenser panel 1141 is removed. The retention portion 1151 could be otherwise shaped, arranged, positioned, and/or configured without departing from the disclosure. For example, the retention portion 1151 could extend across less than the entire width of the ends 1071, 1073 of the carton, or the retention portion could extend upward from the bottom panel 1010 a sufficient height to at least partially contact and retain the end container C in the top layer of the carton 1005.

The blank 1003 and/or carton 1005 could be otherwise shaped, arranged, and/or configured without departing from the disclosure.

Figure 34:
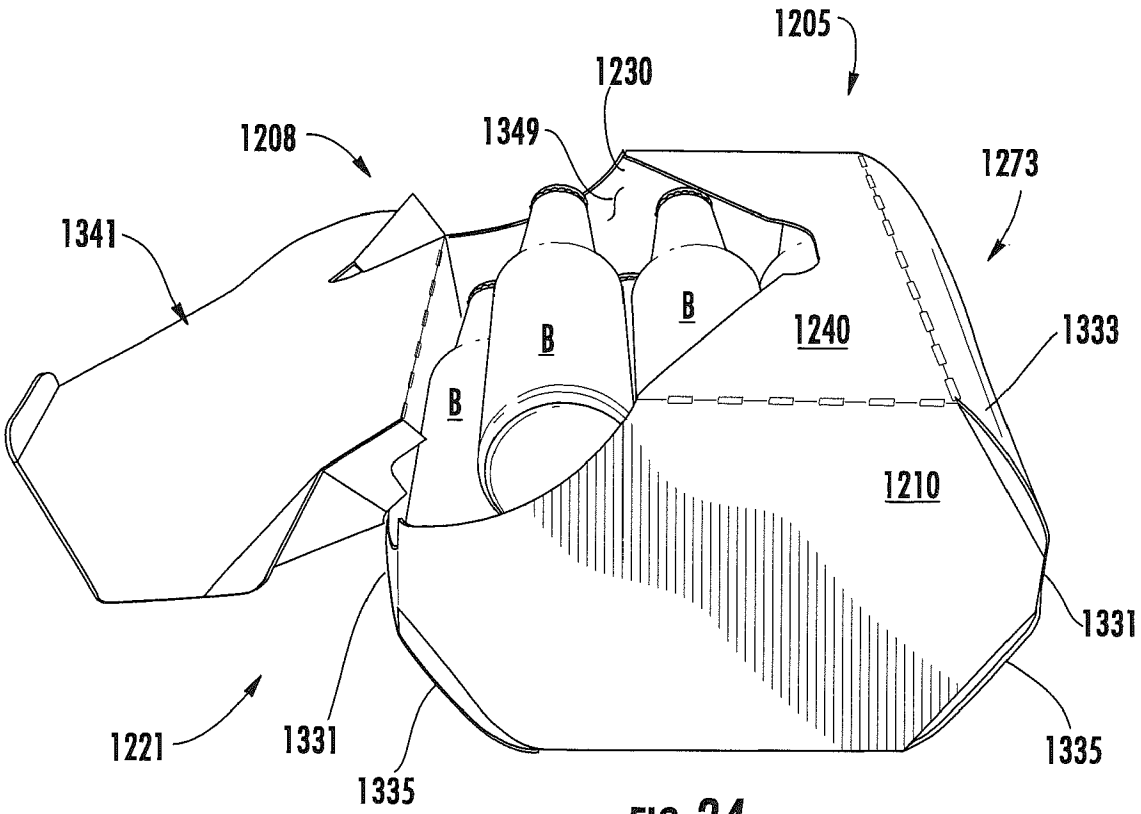
FIG. 34 is a perspective view of a carton according to an eighth embodiment of the disclosure.

FIG. 34 illustrates an eighth embodiment of the disclosure that includes a carton 1205 formed from a blank (not shown). The eighth embodiment is generally similar to the sixth embodiment and/or the seventh embodiment, except for variations noted and variations that will be apparent to one of ordinary skill in the art. Accordingly, similar or identical features of the embodiments have been given like or similar reference numbers. In the eighth embodiment, the carton 1205 is configured to contain ten bottles B in a single layer in a nested arrangement having two outer rows of three bottles per row and one inner row of four bottles. In one embodiment, the bottles B can be arranged similarly to the nested arrangement N4 in FIG. 35 except with only one inner row. The three layers of containers are arranged so that the ends are closed in a similar manner as the first embodiment to form a central portion 1331 and two oblique portions 1333, 1335 at each end 1271, 1273 of the carton 1205. The containers B could be otherwise shaped, arranged, positioned, and/or configured without departing from the disclosure.

As shown in FIG. 34, the carton 1205 includes a dispenser 1208 that is similar to one of the dispensers 1008 of the seventh embodiment or one of the dispensers 806 of the sixth embodiment. The dispenser 1208 includes a dispenser panel 1341 defined by a tear line (already torn as shown in FIG. 34) with curved portions in the bottom panel 1210 and the top panel 1230 and oblique portions in the side panel 1240. When the dispenser 1208 is actuated as shown in FIG. 34, a dispenser opening 1349 is formed in the first end 1271 of the carton, in the side panel 1240, in the bottom panel 1210, and in the top panel 1230. The carton 1205, including the ends 1271, 1273 and/or the dispenser 1208 could be otherwise shaped, arranged, positioned, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising a bottom panel, a top panel, and a side panel; and at least two end flaps at least partially forming an at least partially closed end of the carton, the at least two end flaps comprising a first end flap foldably connected to the bottom panel at a first fold line and a second end flap foldably connected to the bottom panel at a second fold line, wherein the second fold line is oblique relative to the first fold line, the second end flap comprises a base portion comprising a first base section foldably connected to a second base section along an oblique fold line, the second base section is foldably connected to the bottom panel at the second fold line and the first base section is in face-to-face contact with the second base section;

wherein the side panel is foldably connected to the bottom panel, and the at least two end flaps comprise a third end flap foldably connected to the side panel, the third end flap at least partially overlapping the first base section of the second end flap.

2. The carton of claim 1, wherein the first fold line extends in a generally longitudinal direction.

3. The carton of claim 1, wherein the second end flap comprises an outer portion foldably connected to the first base section along a longitudinal fold line.

4. The carton of claim 3, wherein the at least two end flaps further comprise a fourth end flap foldably connected to the bottom panel along a third fold line, the third fold line being oblique relative to the first fold line and the second fold line.

5. The carton of claim 4, wherein the longitudinal fold line is a first longitudinal fold line, the outer portion is a first outer portion, and the base portion is a first base portion, the fourth end flap comprising a second outer portion foldably connected to a second base portion along a second longitudinal fold line, the first end flap at least partially overlapping the first outer portion and the second outer portion.

6. The carton of claim 3, wherein the longitudinal fold line is a first longitudinal fold line, the outer portion is a first outer portion, and the base portion is a first base portion, the third end flap comprises a second outer portion foldably connected to a second base portion along a second longitudinal fold line, the second base portion being foldably connected to the side panel, the second base portion at least partially overlaps the first base portion, and the second outer portion at least partially overlaps the first outer portion.

7. The carton of claim 6, wherein the first base portion of the second end flap and the second base portion of the third end flap are oblique with respect to the side panel and at least a portion of the first end flap.

8. The carton of claim 6, wherein the first end flap at least partially overlaps the first outer portion and the second outer portion.

9. The carton of claim 6, wherein the first base section of the first base portion of the second end flap is foldably connected to the second base portion of the third end flap.

10. The carton of claim 3, wherein the third end flap is foldably connected to the top panel by a gusset.

11. The carton of claim 10, wherein the gusset comprises a first gusset panel foldably connected to the top panel along a first oblique fold line, a second gusset panel foldably connected to the first gusset panel along a second oblique fold line, the second gusset panel at least partially overlapping the first gusset panel.

12. The carton of claim 1, wherein the at least two end flaps further comprise a fourth end flap foldably connected to the bottom panel along a third fold line, the third fold line being oblique relative to the first fold line and the second fold line.

13. The carton of claim 12, wherein the oblique fold line is a first oblique fold line, and the fourth end flap comprises a third base section foldably connected to a fourth base section along a second oblique fold line, the third base section is in face-to-face contact with the fourth section.

14. The carton of claim 13, wherein the side panel is a first side panel, the plurality of panels further comprises a second side panel foldably connected to the bottom panel, the third end flap is a first side end flap, and the at least two end flaps further comprise a second side end flap foldably connected to the second side panel, the first side end flap at least partially overlapping the first base section of the second end flap, and the second side end flap at least partially overlapping the third base section of the fourth end flap.

15. The carton of claim 14, wherein at least a portion of the first side end flap and the second end flap are oblique with respect to the first side panel and at least a portion of the first end flap, and at least a portion of the second side end flap and the fourth end flap are oblique with respect to the second side panel and at least a portion of the first end flap.

16. The carton of claim 14, wherein the first side end flap comprises a first outer portion foldably connected to a first base portion, the second end flap comprises a second outer portion foldably connected to a second base portion, the first base portion and the second base portion at least partially overlap the respective second end flap and fourth end flap, and the first end flap at least partially overlaps the first outer portion and the second outer portion.

17. The carton of claim 1, wherein at least a portion of the third end flap and the second end flap are oblique with respect to the side panel and at least a portion of the first end flap.

18. The carton of claim 1, wherein the base portion is a first base portion and the third end flap comprises an outer portion foldably connected to a second base portion along a longitudinal fold line, the second base portion being foldably connected to the side panel, the second base portion of the third end flap at least partially overlaps the first base section of the second end flap, and the first end flap at least partially overlaps the outer portion of the third end flap.

19. The carton of claim 18, wherein the outer portion of the third end flap is a second outer portion, the second end flap comprising a first outer portion foldably connected to the first base section, the second outer portion of the third end flap at least partially overlapping the first outer portion of the second end flap.

20. The carton of claim 1, wherein the side panel is foldably connected to the bottom panel along a lateral fold line, and the first base section of the second end flap is foldably connected to the third end flap along the lateral fold line.

21. The carton of claim 1, wherein the third end flap is foldably connected to the top panel by a gusset.

22. The carton of claim 21, wherein the gusset comprises a first gusset panel foldably connected to the top panel along a first oblique fold line and a second gusset panel foldably connected to the first gusset panel along a second oblique fold line, the second gusset panel at least partially overlapping the first gusset panel.

23. The carton of claim 21, further comprising a dispenser comprising a dispenser panel and a tear line extending in at least the bottom panel, the side panel, and the top panel.

24. The carton of claim 23, wherein a first end of the tear line is adjacent an end of the second fold line, and a second end of the tear line is adjacent an end of an oblique fold line connecting the gusset to the top panel so that the dispenser panel comprises at least a portion of the second end flap, at least a portion of the third end panel, and at least a portion of the gusset.

25. The carton of claim 1, wherein the at least two end flaps comprise a top end flap foldably connected to the top panel, and the carton comprises a handle comprising a handle panel extending in the top panel and the top end flap.

26. The carton of claim 25, wherein the top panel is a first top panel, the handle panel is a first handle panel, the plurality of panels further comprises a second top panel, the handle further comprises a second handle panel extending in at least the second top panel, the first top panel at least partially overlaps the second top panel, and the first handle panel at least partially overlaps the second handle panel.

27. The carton of claim 1, wherein the third end flap is a side end flap, at least a portion of the side end flap is oblique with respect to the side panel and at least a portion of the first end flap, and the carton further comprises a handle extending in at least the side end flap.

28. The carton of claim 1, further comprising a handle extending in at least one panel of the plurality of panels.

29. A carton for containing a plurality of articles, the carton comprising:

a plurality of panels that extends at least partially around an interior of the carton, the plurality of panels comprising a bottom panel, a top panel, and a side panel; and at least two end flaps at least partially forming an at least partially closed end of the carton, the at least two end flaps comprising a first end flap foldably connected to the bottom panel at a first fold line and a second end flap foldably connected to the bottom panel at a second fold line, wherein the second fold line is oblique relative to the first fold line, the second end flap comprises a base portion comprising a first base section foldably connected to a second base section along an oblique fold line, the second base section is foldably connected to the bottom panel at the second fold line and the first base section is in face-to-face contact with the second base section;

wherein the second end flap comprises an outer portion foldably connected to the first base section along a longitudinal fold line, and the first end flap at least partially overlaps the outer portion of the second end flap.

30. A carton for containing a plurality of articles, the carton comprising:

a plurality of panels that extends at least partially around an interior of the carton, the plurality of panels comprising a bottom panel, a top panel, and a side panel; and at least two end flaps at least partially forming an at least partially closed end of the carton, the at least two end flaps comprising a first end flap foldably connected to one of the plurality of panels at a first fold line and a second end flap foldably connected to the one of the plurality of panels at a second fold line, wherein the second fold line is oblique relative to the first fold line, the second end flap comprises an outer portion foldably connected to a base portion along a longitudinal fold line, the base portion being foldably connected to the at least one panel along the second fold line, the at least two end flaps further comprise a third end flap foldably connected to the one of the plurality of panels along a third fold line, the third fold line being oblique relative to the first fold line and the second fold line, the longitudinal fold line is a first longitudinal fold line, the outer portion is a first outer portion, and the base portion is a first base portion, the third end flap comprising a second outer portion foldably connected to a second base portion along a second longitudinal fold line, the first end flap at least partially overlapping the first outer portion and the second outer portion, each base portion of the respective second end flap and third end flap comprises a first base section foldably connected to a respective second base section along an oblique fold line, each of the first base sections at least partially overlapping the respective second base section.

31. A blank for forming a carton for containing a plurality of articles, the blank comprising:

a plurality of panels comprising a bottom panel, a top panel, and a side panel; and at least two end flaps for at least partially forming an at least partially closed end of the carton formed form the blank, the at least two end flaps comprising a first end flap foldably connected to the bottom panel at a first fold line and a second end flap foldably connected to the bottom panel at a second fold line, wherein the second fold line is oblique relative to the first fold line, the second end flap comprises a first base portion comprising a first base section foldably connected to a second base section along an oblique fold line, the second base section is foldably connected to the bottom panel at the second fold line and the first base section is for being in face-to-face contact with the second base section when the carton is formed from the blank;

wherein the second end flap comprises a first outer portion foldably connected to the first base section along a first longitudinal fold line, the side panel is foldably connected to the bottom panel, the at least two end flaps comprise a third end flap foldably connected to the side panel, and the third end flap comprises a second outer portion foldably connected to a second base portion along a second longitudinal fold line, the second base portion being foldably connected to the side panel.

32. The blank of claim 31, wherein the first fold line extends in a generally longitudinal direction.

33. The blank of claim 31, wherein the at least two end flaps further comprise a fourth end flap foldably connected to the bottom panel along a third fold line, the third fold line being oblique relative to the first fold line and the second fold line.

34. The blank of claim 31, wherein the first base portion of the second end flap and the second base portion of the third end flap are for being disposed in an oblique position with respect to the side panel and at least a portion of the first end flap when the carton is formed from the blank.

35. The blank of claim 31, wherein the first base section of the first base portion of the second end flap is foldably connected to the second base portion of the third end flap.

36. The blank of claim 31, wherein the third end flap is foldably connected to the top panel by a gusset.

37. The blank of claim 36, wherein the gusset comprises a first gusset panel foldably connected to the top panel along a first oblique fold line, a second gusset panel foldably connected to the first gusset panel along a second oblique fold line, the second gusset panel being for at least partially overlapping the first gusset panel when the carton is formed from the blank.

38. The blank of claim 31, wherein the at least two end flaps further comprise a fourth end flap foldably connected to the bottom panel along a third fold line, the third fold line being oblique relative to the first fold line and the second fold line.

39. The blank of claim 38, wherein the oblique fold line is a first oblique fold line, and the fourth end flap comprises a third base section foldably connected to a fourth base section along a second oblique fold line, the third base section being for at least partially overlapping the fourth base section when the carton is formed from the blank.

40. The blank of claim 39, wherein the side panel is a first side panel, the plurality of panels further comprises a second side panel foldably connected to the bottom panel, the third end flap is a first side end flap, and the at least two end flaps further comprise a second side end flap foldably connected to the second side panel, the first side end flap being for at least partially overlapping the first base section of the second end flap and the second side end flap being for at least partially overlapping the third base section of the fourth end flap when the carton is formed from the blank.

41. The blank of claim 40, wherein the second side end flap comprises a third outer portion foldably connected to a third base portion, the second base portion and the third base portion are for at least partially overlapping the respective second end flap and fourth end flap when the carton is formed from the blank, and the first end flap is for at least partially overlapping the second outer portion and the third outer portion when the carton is formed from the blank.

42. The blank of claim 31, wherein the third end flap is for at least partially overlapping the first base section of the second end flap when the carton is formed from the blank.

43. The blank of claim 42, wherein at least a portion of the third end flap and the second end flap are for being disposed in an oblique position with respect to the side panel and at least a portion of the first end flap when the carton is formed from the blank.

44. The blank of claim 42, wherein the second base portion of the third end flap being for at least partially overlapping the first base section of the second end flap when the carton is formed from the blank, and the first end flap is for at least partially overlapping the second outer portion of the third end flap when the carton is formed from the blank.

45. The blank of claim 44, wherein the second outer portion of the third end flap is for at least partially overlapping the first outer portion of the second end flap when the carton is formed from the blank.

46. The blank of claim 42, wherein the side panel is foldably connected to the bottom panel along a lateral fold line, and the first base section of the second end flap is foldably connected to the third end flap along the lateral fold line.

47. The blank of claim 42, wherein the third end flap is foldably connected to the top panel by a gusset.

48. The blank of claim 47, wherein the gusset comprises a first gusset panel foldably connected to the top panel along a first oblique fold line and a second gusset panel foldably connected to the first gusset panel along a second oblique fold line, the second gusset panel being for at least partially overlapping the first gusset panel when the carton is formed from the blank.

49. The blank of claim 47, further comprising dispenser features for forming a dispenser in the carton formed from the blank, the dispenser features comprising a dispenser panel and a tear line extending in at least the bottom panel, the side panel, and the top panel.

50. The blank of claim 49, wherein a first end of the tear line is adjacent an end of the second fold line, and a second end of the tear line is adjacent an end of an oblique fold line connecting the gusset to the top panel so that the dispenser panel comprises at least a portion of the second end flap, at least a portion of the third end flap, and at least a portion of the gusset.

51. The blank of claim 31, wherein the at least two end flaps comprise a top end flap foldably connected to the top panel, and the blank comprises a handle comprising a handle panel extending in the top panel and the top end flap.

52. The blank of claim 51, wherein the top panel is a first top panel, the handle panel is a first handle panel, the plurality of panels further comprises a second top panel, the handle further comprises a second handle panel extending in at least the second top panel, the first top panel being for at least partially overlapping the second top panel when the carton is formed from the blank, and the first handle panel being for at least partially overlapping the second handle panel when the carton is formed from the blank.

53. The blank of claim 31, wherein the third end flap is a side end flap, and the blank further comprises handle features for forming a handle extending in at least the side end flap when the carton is formed from the blank.

54. The blank of claim 31, further comprising handle features for forming a handle extending in at least one panel of the plurality of panels when the carton is formed from the blank.

55. A blank for forming a carton for containing a plurality of articles, the blank comprising:

a plurality of panels comprising a bottom panel, a top panel, and a side panel; and at least two end flaps for at least partially forming an at least partially closed end of the carton formed form the blank, the at least two end flaps comprising a first end flap foldably connected to the bottom panel at a first fold line and a second end flap foldably connected to the bottom panel at a second fold line, wherein the second fold line is oblique relative to the first fold line, the second end flap comprises a first base portion comprising a first base section foldably connected to a second base section along an oblique fold line, the second base section is foldably connected to the bottom panel at the second fold line and the first base section is for being in face-to-face contact with the second base section when the carton is formed from the blank;

wherein the second end flap comprises a first outer portion foldably connected to the first base section along a first longitudinal fold line, the at least two end flaps further comprise a third end flap foldably connected to the bottom panel along a third fold line, the third fold line being oblique relative to the first fold line and the second fold line, the third end flap comprising a second outer portion foldably connected to a second base portion along a second longitudinal fold line, the first end flap being for at least partially overlapping the first outer portion and the second outer portion when the carton is formed from the blank.

56. A blank for forming a carton for containing a plurality of articles, the blank comprising:

a plurality of panels comprising a bottom panel, a top panel, and a side panel; and at least two end flaps for at least partially forming an at least partially closed end of the carton formed form the blank, the at least two end flaps comprising a first end flap foldably connected to one of the plurality of panels at a first fold line and a second end flap foldably connected to the one of the plurality of panels at a second fold line, wherein the second fold line is oblique relative to the first fold line, the second end flap comprises an outer portion foldably connected to a base portion along a longitudinal fold line, the base portion being foldably connected to the at least one panel along the second fold line, the at least two end flaps further comprise a third end flap foldably connected to the one of the plurality of panels along a third fold line, the third fold line being oblique relative to the first fold line and the second fold line, the longitudinal fold line is a first longitudinal fold line, the outer portion is a first outer portion, and the base portion is a first base portion, the third end flap comprising a second outer portion foldably connected to a second base portion along a second longitudinal fold line, the first end flap being for at least partially overlapping the first outer portion and the second outer portion when the carton is formed from the blank, each of the second end flap and the third end flap comprises a first base section foldably connected to a respective second base section along an oblique fold line, each of the first base sections being for at least partially overlapping the respective second base section when the carton is formed from the blank.

57. A method of forming a carton for containing a plurality of articles, the method comprising:

obtaining a blank comprising a plurality of panels comprising a bottom panel, a top panel, and a side panel, and at least two end flaps comprising a first end flap foldably connected to at the bottom panel at a first fold line and a second end flap foldably connected to the bottom panel at a second fold line, wherein the second fold line is oblique relative to the first fold line, the second end flap comprises a base portion comprising a first base section foldably connected to a second base section along an oblique fold line, the second base section is foldably connected to the bottom panel at the second fold line, the side panel is foldably connected to the bottom panel, and the at least two end flaps comprise a third end flap foldably connected to the side panel;

forming an interior of the carton at least partially defined by the plurality of panels, the forming the interior of the carton comprising forming an open-ended sleeve; and forming an at least partially closed end of the carton by at least partially overlapping the at least two end flaps and positioning the first base section in face-to-face contact with the second base section, wherein the at least partially overlapping the at least two end flaps comprises positioning the third end flap to at least partially overlap the first base section of the second end flap.

58. The method of claim 57, wherein the second end flap comprises an outer portion foldably connected to the first base section along a longitudinal fold line, and the forming the at least partially closed end of the carton comprises positioning the first end flap to at least partially overlap the outer portion of the second end flap.

59. The method of claim 58, wherein the forming the at least partially closed end of the carton further comprising folding the base portion along the oblique fold line.

60. The method of claim 58, wherein the forming the at least partially closed end further comprises positioning at least a portion of the first end flap to be generally perpendicular to the side panel and positioning the base portion of the second end flap to be oblique with respect to the side panel and the first end flap.

61. The method of claim 60, wherein the forming the at least partially closed end further comprises positioning the outer portion of the second end flap to at least partially overlap the first end flap.

* * * * *